US010049628B2

(12) United States Patent
Kim et al.

(10) Patent No.: US 10,049,628 B2
(45) Date of Patent: Aug. 14, 2018

(54) DISPLAY DEVICE AND DRIVING METHOD THEREOF

(71) Applicant: SAMSUNG DISPLAY CO., LTD., Yongin-si, Gyeonggi-do (KR)

(72) Inventors: Hyeon Jin Kim, Tongyeong-si (KR); Il Yong Yoon, Seoul (KR); Gyu Hyeon Kim, Suwon-si (KR); Ji Hoon Kim, Seoul (KR); Se Huhn Hur, Yongin-si (KR); Seon Ki Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 157 days.

(21) Appl. No.: 14/855,133

(22) Filed: Sep. 15, 2015

(65) Prior Publication Data

US 2016/0155405 A1 Jun. 2, 2016

(30) Foreign Application Priority Data

Dec. 1, 2014 (KR) ..... 10-2014-0170008

(51) Int. Cl.
*G09G 5/00* (2006.01)
*G09G 3/36* (2006.01)
(Continued)

(52) U.S. Cl.
CPC ..... *G09G 3/3648* (2013.01); *G09G 3/003* (2013.01); *G09G 3/2011* (2013.01);
(Continued)

(58) Field of Classification Search
CPC ..... G09G 2310/027; G09G 2310/0272; G09G 2310/0275; G09G 2310/0278;
(Continued)

(56) References Cited

U.S. PATENT DOCUMENTS 5,838,381 A * 11/1998 Kasahara ..... G09G 5/00 348/458
2003/0058229 A1* 3/2003 Kawabe ..... G09G 3/342 345/204

(Continued)

FOREIGN PATENT DOCUMENTS

JP 2013-073036 A 4/2013
KR 10-2007-0109296 A 11/2007

(Continued)

*Primary Examiner* — Jennifer Nguyen
(74) *Attorney, Agent, or Firm* — Lewis Roca Rothgerber Christie LLP

(57) ABSTRACT

A display device includes gate lines, data lines, pixels connected to the gate lines and data lines, a data driver, a gate driver, and a signal controller for controlling the data driver and gate driver. A method for driving the display device includes: compressing, by the signal controller, vertical resolution of input image data of each frame by k or receiving by the signal controller the compressed input image data; processing by the signal controller the compressed input image data to generate output image data; generating, by the data driver, data voltages based on the output image data and applying the data voltages to the data lines; and applying, by the gate driver, gate-on voltage pulses concurrently to k neighboring gate lines corresponding to the applied data voltages. Starting times of the gate-on voltage pulses of at least two of the k neighboring gate lines are different from each other.

11 Claims, 31 Drawing Sheets

(51) Int. Cl.
*G09G 3/00* (2006.01)
*G09G 3/20* (2006.01)

(52) U.S. Cl.
CPC ..... *G09G 3/2096* (2013.01); *G09G 2310/021* (2013.01); *G09G 2310/0224* (2013.01); *G09G 2310/08* (2013.01); *G09G 2320/0209* (2013.01); *G09G 2340/0435* (2013.01)

(58) Field of Classification Search
CPC ..... G09G 5/227; G09G 2310/0264; G09G 2320/02; G09G 3/3266; G09G 3/3275
USPC ..... 345/76, 87, 98, 100, 204, 690
See application file for complete search history.

(56) References Cited

U.S. PATENT DOCUMENTS

| | | | | |
|---|---|---|---|---|
| 2009/0109133 | A1* | 4/2009 | Park | G09G 3/3648 345/55 |
| 2010/0045782 | A1* | 2/2010 | Morita | H04N 13/004 348/51 |
| 2010/0074322 | A1* | 3/2010 | Terashima | G09G 5/36 375/240.01 |

FOREIGN PATENT DOCUMENTS

| | | | |
|---|---|---|---|
| KR | 10-2010-0128019 | A | 12/2010 |
| KR | 10-2011-0138677 | A | 12/2011 |
| KR | 10-2013-0004883 | A | 1/2013 |
| KR | 10-2013-0032161 | A | 4/2013 |

* cited by examiner

FIG. 2

| Gate line number | Image data | | | |
|---|---|---|---|---|
| | Inputs (full resolution) | Outputs (Frame alternate) | | |
| | | F(N) | F(N+1) | Avg |
| 1 | IDAT_G1 | DAT_G1 | DAT_G2 | Avg(DAT_G1,DAT_G2) |
| 2 | IDAT_G2 | DAT_G1 | DAT_G2 | Avg(DAT_G1,DAT_G2) |
| 3 | IDAT_G3 | DAT_G3 | DAT_G4 | Avg(DAT_G3,DAT_G4) |
| 4 | IDAT_G4 | DAT_G3 | DAT_G4 | Avg(DAT_G3,DAT_G4) |
| 5 | IDAT_G5 | DAT_G5 | DAT_G6 | Avg(DAT_G5,DAT_G6) |
| 6 | IDAT_G6 | DAT_G5 | DAT_G6 | Avg(DAT_G5,DAT_G6) |

FIG. 6

| Gate line number | Image data | |
|---|---|---|
| | Inputs (full resolution) | Outputs (Interpolation driving) |
| 1 | IDAT_G1 | DAT_G1 |
| 2 | IDAT_G2 | Avg(DAT_G1,DAT_G3) |
| 3 | IDAT_G3 | DAT_G3 |
| 4 | IDAT_G4 | Avg(DAT_G3,DAT_G5) |
| 5 | IDAT_G5 | DAT_G5 |
| 6 | IDAT_G6 | Avg(DAT_G5,DAT_G7) |

FIG. 13

| Gate line number | Image data | | | |
|---|---|---|---|---|
| | Inputs (full resolution) | Outputs (Interpolation and alternation) | | |
| | | F(N) | F(N+1) | Avg |
| 1 | IDAT_G1 | DAT_G1 | Avg(X,DAT_G2) | (2×DAT_G1+X+DAT_G2)/4 |
| 2 | IDAT_G2 | Avg(DAT_G1,DAT_G3) | DAT_G2 | (2×DAT_G2+DAT_G1+DAT_G3)/4 |
| 3 | IDAT_G3 | DAT_G3 | Avg(DAT_G2,DAT_G4) | (2×DAT_G3+DAT_G2+DAT_G4)/4 |
| 4 | IDAT_G4 | Avg(DAT_G3,DAT_G5) | DAT_G4 | (2×DAT_G4+DAT_G3+DAT_G5)/4 |
| 5 | IDAT_G5 | DAT_G5 | Avg(DAT_G4,DAT_G6) | (2×DAT_G5+DAT_G4+DAT_G6)/4 |
| 6 | IDAT_G6 | Avg(DAT_G5,DAT_G7) | DAT_G6 | (2×DAT_G6+DAT_G5+DAT_G7)/4 |

FIG. 18

| Gate line number | Image data | | | |
|---|---|---|---|---|
| | Inputs (full resolution) | Outputs (Alternation) | | |
| | | F(N) | F(N+1) | Avg |
| 1 | IDAT_G1 | DAT_G1 | DAT_G1 | DAT_G1 |
| 2 | IDAT_G2 | DAT_G1 | DAT_G3 | Avg(DAT_G1,DAT_G3) |
| 3 | IDAT_G3 | DAT_G3 | DAT_G3 | DAT_G3 |
| 4 | IDAT_G4 | DAT_G3 | DAT_G5 | Avg(DAT_G3,DAT_G5) |
| 5 | IDAT_G5 | DAT_G5 | DAT_G5 | DAT_G5 |
| 6 | IDAT_G6 | DAT_G5 | DAT_G7 | Avg(DAT_G5,DAT_G7) |

FIG. 22

| Gate line number | Image data | | | |
|---|---|---|---|---|
| | Inputs (full resolution) | Outputs (Alternation) | | |
| | | F(N) | F(N+1) | Avg |
| 1 | IDAT_G1 | DAT_G2 | DAT_G1 | Avg(DAT_G1,DAT_G2) |
| 2 | IDAT_G2 | DAT_G2 | DAT_G3 | Avg(DAT_G2,DAT_G3) |
| 3 | IDAT_G3 | DAT_G4 | DAT_G3 | Avg(DAT_G3,DAT_G4) |
| 4 | IDAT_G4 | DAT_G4 | DAT_G5 | Avg(DAT_G4,DAT_G5) |
| 5 | IDAT_G5 | DAT_G6 | DAT_G5 | Avg(DAT_G5,DAT_G6) |
| 6 | IDAT_G6 | DAT_G6 | DAT_G7 | Avg(DAT_G6,DAT_G7) |

FIG. 26

| Gate line number | Image data | | | |
|---|---|---|---|---|
| | Inputs (full resolution) | Outputs (Alternation) | | |
| | | F(N) | F(N+1) | Avg |
| 1 | IDAT_G1 | DAT_G1 | X | Avg(X,DAT_G1) |
| 2 | IDAT_G2 | DAT_G1 | DAT_G2 | Avg(DAT_G1,DAT_G2) |
| 3 | IDAT_G3 | DAT_G3 | DAT_G2 | Avg(DAT_G2,DAT_G3) |
| 4 | IDAT_G4 | DAT_G3 | DAT_G4 | Avg(DAT_G3,DAT_G4) |
| 5 | IDAT_G5 | DAT_G5 | DAT_G4 | Avg(DAT_G4,DAT_G5) |
| 6 | IDAT_G6 | DAT_G5 | DAT_G6 | Avg(DAT_G5,DAT_G6) |

DISPLAY DEVICE AND DRIVING METHOD THEREOF

CROSS-REFERENCE TO RELATED APPLICATION

This application claims priority to and the benefit of Korean Patent Application No. 10-2014-0170008, filed in the Korean Intellectual Property Office on Dec. 1, 2014, the entire content of which is incorporated herein by reference.

BACKGROUND

1. Field

Aspects of embodiments of the present invention relate to a display device and a driving method of the display device.

2. Description of Related Art

Display devices, such as liquid crystal displays (LCDs) and organic light emitting diode displays, generally each include a display panel and a driving device for driving the display panel. The display panel includes a plurality of signal lines and a plurality of pixels connected thereto and arranged substantially in a matrix form. The signal lines include a plurality of gate lines transferring gate signals and a plurality of data lines transferring data voltages, or the like. Each pixel may include at least one switching element connected to a corresponding gate line and a corresponding data line, at least one pixel electrode connected thereto, and an opposing electrode facing the pixel electrode and receiving a common voltage.

The switching element may include at least one thin film transistor, and is turned on or off according to a gate signal transmitted by the gate line to selectively transmit a data voltage corresponding to an image signal transmitted by the data line to the pixel electrode. Each pixel receives the data voltage, corresponding to desired luminance, through the switching element. The data voltage supplied to each pixel is applied as a corresponding pixel voltage to the pixel electrode and the pixel displays the desired luminance as a gray level corresponding to a difference between the pixel voltage and a common voltage supplied to the opposing electrode.

A driving device of the display device includes a graphics controller, a driver, and a signal controller for controlling the driver. The graphics controller transmits input image data for an image to be displayed to the signal controller. The input image data has luminance information for the respective pixels, and each luminance is represented by a predetermined number. The signal controller generates control signals for driving the display panel and transmits the control signals and the image data to the driver. The driver includes a gate driver for generating gate signals and a data driver for generating data voltages.

In order to display images by pixels with desired luminance at the right time, the pixels need to charge for a sufficient period of time, and gate doubling may be used to accomplish this. For each row of pixels, gate doubling outputs compressed image data of two or more rows, and at least doubles the frame rate by simultaneously driving a plurality of gate lines for at least part of the time. As such, gate doubling allows continuous input of output image data for the same input image data to the display panel for multiple gate lines concurrently to increase a response speed of the pixels and reduce crosstalk between neighboring frames. However, gate doubling outputs compressed image data, so vertical resolution may deteriorate.

Gate doubling driving may be usable for displaying 3D images or multi-view images as well as 2D images. In general, with 3D image display technology, a 3D effect of an object is expressed by using binocular parallax, which is the largest factor with regard to recognizing the 3D effect at short range. With binocular parallax, when different 2D images are displayed concurrently to the left eye and the right eye, respectively, and the image displayed to and received by the left eye (hereinafter referred to as the "left eye image") and the image displayed to and received by the right eye (hereinafter referred to as the "right eye image") are transmitted from the optic nerves of the left and right eyes to the brain, the left eye image and the right eye image are fused in the brain and recognized as a 3D image having 3D effects such as depth.

A 3D image display device capable of displaying 3D images uses binocular parallax. 3D image display devices include stereoscopic 3D image display devices using glasses (such as shutter glasses, polarized glasses, or the like) to generate the 3D effect, and autostereoscopic 3D image display devices, which use an optical system (such as a lenticular lens, a parallax barrier, or the like) in the display device to generate the 3D effect without using glasses.

When the stereoscopic 3D image display devices using shutter glasses display 3D images, frames of left-eye images and right-eye images are separated from each other and alternately displayed to decrease crosstalk between neighboring frames intended for different eyes. Therefore, when such a display panel is driven according to the gate doubling driving scheme, the same image data may be input to the display panel with a faster frame rate (thereby increasing the pixel's response speed) and while reducing the crosstalk between neighboring frames. These are also applicable to multi-view display devices for displaying different images to an observer as well as to other 3D image display devices.

With gate doubling driving, vertical resolution of output image data output to the display panel may be less than or equal to half the vertical resolution of output image data that do not undergo gate doubling. As such, shapes or edges having curved lines (such as a circle) or oblique angles may not appear'smooth but rather like saw teeth, which is called aliasing. Aliasing usually worsens resolution of images and deteriorates image quality.

The above information disclosed in this Background section is for enhancement of understanding of the background of the present invention and therefore it may contain information that does not form the prior art already known in this country to a person of ordinary skill in the art.

SUMMARY

Embodiments of the present invention provide for a display device and corresponding driving method that soften image edges by lessening the aliasing phenomenon that may occur when vertical resolution is reduced because of gate doubling driving. Further embodiments of the present invention provide for a display device and corresponding driving method for controlling resolution degradation by displaying image data with further information.

According to an embodiment of the present invention, a method for driving a display device is provided. The display device includes a plurality of gate lines, a plurality of data lines, a plurality of pixels each including a switching element connected to one of the gate lines and one of the data lines, a data driver, a gate driver, and a signal controller for controlling the data driver and the gate driver. The method includes: compressing, by the signal controller, vertical resolution of input image data of each of a plurality of frames including a first frame by k (k is a natural number greater than one) or receiving by the signal controller the compressed input image data; processing by the signal controller the compressed input image data to generate output image data; generating, by the data driver, data voltages based on the output image data and applying the data voltages to the data lines; and applying, by the gate driver, gate-on voltage pulses concurrently to k neighboring ones of the gate lines corresponding to the applied data voltages. In the first frame, starting times of the gate-on voltage pulses of at least two gate lines from among the k neighboring ones of the gate lines are different from each other.

The output image data may include first output image data and second output image data. The data voltages may include first data voltages and second data voltages corresponding to the first output image data and the second output image data, respectively, the first data voltages and the second data voltages being consecutively applied to the data lines. The k neighboring ones of the gate lines may include a first k neighboring ones of the gate lines and a second k neighboring ones of the gate lines, the first k neighboring ones of the gate lines corresponding to the applied first data voltages and the second k neighboring ones of the gate lines corresponding to the applied second data voltages. The first k neighboring ones of the gate lines may include a first gate line and a second gate line. The second k neighboring ones of the gate lines may include a third gate line and a fourth gate line. The gate-on voltage pulses may include first, second, third, and fourth gate-on voltage pulses for respectively applying to the first, second, third, and fourth gate lines. The starting time for the second gate-on voltage pulse may be between those of the first gate-on voltage pulse and the third gate-on voltage pulse.

The first gate-on voltage pulse may be applied in synchronization with the applied first data voltages. The third gate-on voltage pulse may be applied in synchronization with the applied second data voltages.

The output image data may include odd-row compressed data or odd-row interpolated and compressed data. The odd-row compressed data may be generated by extracting the input image data corresponding to an odd row of the pixels. The odd-row interpolated and compressed data may be generated by interpolating the input image data corresponding to an even row of the pixels preceding the odd row and the input image data corresponding to an even row of the pixels following the odd row.

A second frame of the plurality of frames may alternate with the first frame with a vertical blank section therebetween. The first gate-on voltage pulse may overlap the vertical blank section.

In the first frame, the output image data may include odd-row compressed data or odd-row interpolated and compressed data. In the second frame, the output image data may include even-row compressed data or even-row interpolated and compressed data. The odd-row compressed data may be generated by extracting the input image data corresponding to odd rows of the pixels. The odd-row interpolated and compressed data may be generated by interpolating the input image data corresponding to respective even rows of the pixels preceding the odd rows and the input image data corresponding to respective even rows of the pixels following the odd rows. The even-row compressed data may be generated by extracting the input image data corresponding to even rows of the pixels. The even-row interpolated and compressed data may be generated by interpolating the input image data corresponding to respective odd rows of the pixels preceding the even rows and the input image data corresponding to respective odd rows of the pixels following the even rows.

Lengths of an overlapping section of the first gate-on voltage pulse and the second gate-on voltage pulse may be different from each other in two neighboring frames of the plurality of frames.

The output image data may include odd-row compressed data or odd-row interpolated and compressed data. The odd-row compressed data may be generated by extracting the input image data corresponding to an odd row of the pixels. The odd-row interpolated and compressed data are generated by interpolating the input image data corresponding to an even row of the pixels preceding the odd row and the input image data corresponding to an even row of the pixels following the odd row.

The input image data in the first frame may include image data for a first viewpoint, and the input image data in a second frame following the first frame from among the plurality of frames may include image data for a second viewpoint different from the first viewpoint.

The input image data in the first frame and the input image data in a second frame following the first frame from among the plurality of frames may include image data for the same viewpoint.

According to another embodiment of the present invention, a method for driving a display device is provided. The display device includes a plurality of gate lines, a plurality of data lines, a plurality of pixels each including a switching element connected to one of the gate lines and one of the data lines, a data driver, a gate driver, and a signal controller for controlling the data driver and the gate driver. The method includes: compressing, by the signal controller, vertical resolution of input image data of each of a plurality of frames including a first frame by k (k is a natural number greater than one) or receiving by the signal controller the compressed input image data; processing by the signal controller the compressed input image data to generate output image data; generating, by the data driver, data voltages based on the output image data and applying the data voltages to the data lines; applying, by the gate driver in the first frame, gate-on voltage pulses concurrently to k neighboring ones of the gate lines corresponding to the applied data voltages; and applying, by the gate driver in neighboring frames of the first frame from among the plurality of frames, the gate-on voltage pulses to the k neighboring ones of the gate lines. The gate-on voltage pulses of the k neighboring ones of the gate lines are not applied concurrently in the neighboring frames of the first frame.

The output image data may include first output image data and second output image data. The data voltages may include first data voltages and second data voltages corresponding to the first output image data and the second output image data, respectively. The first data voltages and the second data voltages may be consecutively applied to the data lines. The k neighboring ones of the gate lines may include a first k neighboring ones of the gate lines and a second k neighboring ones of the gate lines, the first k neighboring ones of the gate lines corresponding to the applied first data voltages and the second k neighboring ones of the gate lines corresponding to the applied second data voltages. In the first frame, the first k neighboring ones of the gate lines may include a first gate line and a second gate line. In the first frame, the second k neighboring ones of the gate lines may include a third gate line and a fourth gate line. The gate-on voltage pulses may include first, second, third, and fourth gate-on voltage pulses for respectively applying to the first, second, third, and fourth gate lines. In a second frame neighboring the first frame from among the plurality of frames, the first gate-on voltage pulse and the second gate-on voltage pulse may not be applied concurrently. In the second frame, the second gate-on voltage pulse and the third gate-on voltage pulse may be applied concurrently.

In the first frame, the first gate-on voltage pulse and the second gate-on voltage pulse may be applied in synchronization with the applied first data voltages. In the first frame, the third gate-on voltage pulse and the fourth gate-on voltage pulse may be applied in synchronization with the applied second data voltages.

In the second frame, the first gate-on voltage pulse may be applied in synchronization with the applied first data voltages. In the second frame, the second gate-on voltage pulse and the third gate-on voltage pulse may be applied in synchronization with the applied second data voltages.

The output image data may include odd-row compressed data or odd-row interpolated and compressed data. The odd-row compressed data may be generated by extracting the input image data corresponding to an odd row of the input image data. The odd-row interpolated and compressed data may be generated by interpolating the input image data corresponding to an even row of the pixels preceding the odd row and the input image data corresponding to an even row of the pixels following the odd row.

In the first frame, the output image data may include odd-row compressed data or odd-row interpolated and compressed data. In the second frame, the output image data may include even-row compressed data or even-row interpolated and compressed data. The odd-row compressed data may be generated by extracting the input image data corresponding to odd rows of the pixels. The odd-row interpolated and compressed data may be generated by interpolating the input image data corresponding to respective even rows of the pixels preceding the odd rows and the input image data corresponding to respective even rows of the pixels following the odd rows. The even-row compressed data may be generated by extracting the input image data corresponding to even rows of the pixels. The even-row interpolated and compressed data may be generated by interpolating the input image data corresponding to respective odd rows of the pixels preceding the even rows and the input image data corresponding to respective odd rows of the pixels following the even rows.

In the second frame, the first gate-on voltage pulse may overlap a vertical blank section between the first frame and the second frame.

The input image data in the first frame may include image data for a first viewpoint. The input image data in a second frame neighboring the first frame from among the plurality of frames may include image data for a second viewpoint different from the first viewpoint.

The input image data in the first frame and the input image data in a second frame neighboring the first frame from among the plurality of frames may include image data for the same viewpoint.

According to yet another embodiment of the present invention, a method for driving a display device is provided. The display device includes a plurality of gate lines, a plurality of data lines, a plurality of pixels each including a switching element connected to one of the gate lines and one of the data lines, a data driver, a gate driver, and a signal controller for controlling the data driver and the gate driver. The method may include: compressing, by the signal controller, vertical resolution of input image data of each of a plurality of frames including a first frame by k (k is a natural number greater than one) or receiving by the signal controller the compressed input image data; processing by the signal controller the compressed input image data to generate output image data; generating, by the data driver, data voltages based on the output image data and applying the data voltages to the data lines; and applying, by the gate driver, gate-on voltage pulses concurrently to k neighboring ones of the gate lines corresponding to the applied data voltages. The output image data of the first frame is generated by using a method different from the output image data of a second frame alternating with the first frame from among the plurality of frames.

The output image data may include first output image data and second output image data. The data voltages may include first data voltages and second data voltages corresponding to the first output image data and the second output image data, respectively. The first data voltages and the second data voltages may be consecutively applied to the data lines. The k neighboring ones of the gate lines may include a first k neighboring ones of the gate lines and a second k neighboring ones of the gate lines. The first k neighboring ones of the gate lines may correspond to the applied first data voltages and the second k neighboring ones of the gate lines may correspond to the applied second data voltages. In the first frame and the second frame, the first k neighboring ones of the gate lines may include a first gate line and a second gate line. In the first frame and the second frame, the second k neighboring ones of the gate lines may include a third gate line and a fourth gate line.

The gate-on voltage pulses may include first, second, third, and fourth gate-on voltage pulses for respectively applying to the first, second, third, and fourth gate lines, In the first frame and the second frame, the first gate-on voltage pulse and the second gate-on voltage pulse may be applied in synchronization with the applied first data voltages. In the first frame and the second frame, the third gate-on voltage pulse and the fourth gate-on voltage pulse may be applied in synchronization with the applied second data voltages.

The output image data of the first frame may include odd-row compressed data or odd-row interpolated and compressed data. The output image data of the second frame may include even-row compressed data or even-row interpolated and compressed data. The odd-row compressed data may be generated by extracting the input image data corresponding to odd rows of the pixels. The odd-row interpolated and compressed data may be generated by interpolating the input image data corresponding to respective even rows of the pixels preceding the odd rows and the input image data corresponding to respective even rows of the pixels following the odd rows. The even-row compressed data may be generated by extracting the input image data corresponding to even rows of the pixels. The even-row interpolated and compressed data may be generated by interpolating the input image data corresponding to respective odd rows of the pixels preceding the even rows and the input image data corresponding to respective odd rows of the pixels following the even rows.

According to still yet another embodiment of the present invention, a display device is provided. The display device includes: a plurality of gate lines and a plurality of data lines; a plurality of pixels each including a switching element connected to one of the gate lines and one of the data lines; a signal controller for compressing vertical resolution of input image data of each of a plurality of frames including a first frame by k (k is a natural number greater than one) or receiving the compressed input image data, and processing the compressed input image data to generate output image data; a data driver for generating data voltages based on the output image data and applying the data voltages to the data lines; and a gate driver for applying gate-on voltage pulses concurrently to k neighboring ones of the gate lines corresponding to the applied data voltages. In the first frame, starting times of the gate-on voltage pulses of at least two gate lines from among the k neighboring ones of the gate lines may be different from each other.

According to still another embodiment of the present invention, a display device is provided. The display device includes: a plurality of gate lines and a plurality of data lines; a plurality of pixels each including a switching element connected to one of the gate lines and one of the data lines; a signal controller for compressing vertical resolution of input image data of each of a plurality of frames including a first frame by k (k is a natural number greater than one) or receiving the compressed input image data, and processing the compressed input image data to generate output image data; a data driver for generating data voltages based on the output image data and applying the data voltages to the data lines; and a gate driver for applying, in the first frame, gate-on voltage pulses concurrently to k neighboring ones of the gate lines corresponding to the applied data voltages, and applying, in neighboring frames of the first frame from among the plurality of frames, the gate-on voltage pulses to the k neighboring ones of the gate lines. The gate-on voltage pulses of the k neighboring ones of the gate lines are not applied concurrently in the neighboring frames of the first frame.

According to still another embodiment of the present invention, a display device is provided. The display device includes: a plurality of gate lines and a plurality of data lines; a plurality of pixels each including a switching element connected to one of the gate lines and one of the data lines; a signal controller for compressing vertical resolution of input image data of each of a plurality of frames including a first frame by k (k is a natural number greater than one) or receiving the compressed input image data, and processing the compressed input image data to generate output image data; a data driver for generating data voltages based on the output image data and applying the data voltages to the data lines; and a gate driver for applying gate-on voltage pulses concurrently to k neighboring ones of the gate lines corresponding to the applied data voltages. The output image data of the first frame are generated by using a method different from the output image data of a second frame alternating with the first frame from among the plurality of frames.

According to embodiments of display devices and corresponding driving methods of the present invention, image edges may be seen as smooth by lessening the aliasing phenomenon that may occur when vertical resolution is reduced because of gate doubling driving, and resolution degradation may be controlled by displaying image data with further information.

BRIEF DESCRIPTION OF THE DRAWINGS

FIG. 2 is a table of output image data applied to pixels connected to gate lines in neighboring frames when a display device is driven by a gate doubling scheme according to an embodiment of the present invention.

FIG. 6 is a table of output image data applied to pixels connected to gate lines in neighboring frames when a display device is driven by a gate doubling scheme according to another embodiment of the present invention.

FIG. 13 is a table of output image data applied to pixels connected to gate lines in neighboring frames when a display device is driven by a gate doubling scheme according to yet another embodiment of the present invention.

FIG. 18 shows a table of output image data applied to pixels connected to gate lines in neighboring frames when a display device is driven by a gate doubling scheme according to still yet another embodiment of the present invention.

FIG. 22 is a table of output image data applied to pixels connected to gate lines in neighboring frames when a display device driven by a gate doubling scheme according to still another gate doubling scheme.

FIG. 26 is a table of output image data applied to pixels connected to gate lines in neighboring frames when a display device is driven by a gate doubling scheme according to still another embodiment of the present invention.

DETAILED DESCRIPTION

Figure 1:
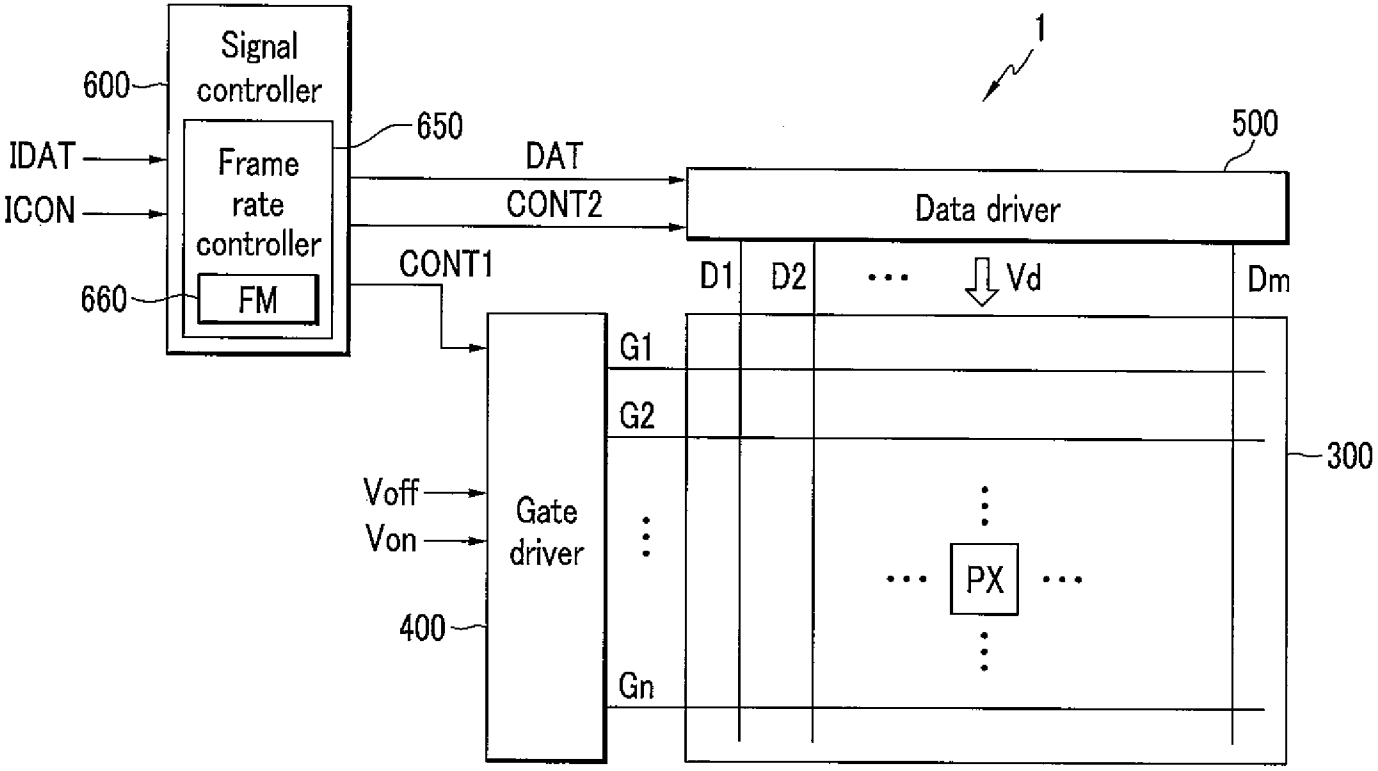
FIG. 1 is a block diagram of a display device according to an embodiment of the present invention.

The present invention will be described more fully hereinafter with reference to the accompanying drawings, in which embodiments of the invention are shown. As those skilled in the art would realize, the described embodiments may be modified in various different ways, all without departing from the spirit or scope of the present invention.

In the drawings, the thickness of layers, films, panels, regions, substrates, etc., may be exaggerated for clarity. Like reference numerals designate like elements throughout the specification. It will be understood that when an element such as a layer, film, panel, region, substrate, etc., is referred to as being "on" another element, it may be directly on the other element or intervening elements may also be present. In contrast, when an element is referred to as being "directly on" another element, there are no intervening elements present.

Throughout this specification and the claims that follow, when it is described that an element is "coupled" to another element, the element may be "directly coupled" to the other element or "electrically coupled" to the other element through one or more third elements. In addition, unless explicitly described to the contrary, the word "comprise" and variations such as "comprises" or "comprising" will be understood to imply the inclusion of stated elements but not the exclusion of any other elements.

Herein, the use of the term "may," when describing embodiments of the present invention, refers to "one or more embodiments of the present invention." In addition, the use of alternative language, such as "or," when describing embodiments of the present invention, refers to "one or more embodiments of the present invention" for each corresponding item listed.

The display devices and/or any other relevant devices or components according to embodiments of the present invention described herein may be implemented utilizing any suitable hardware, firmware (e.g., an application-specific integrated circuit), software, or a suitable combination of software, firmware, and hardware. For example, the various components of the display devices may be formed on one integrated circuit (IC) chip or on separate IC chips. Further, the various components of the display devices may be implemented on a flexible printed circuit film, a tape carrier package (TCP), a printed circuit board (PCB), or formed on a same substrate as the display device.

Further, the various components of the display devices may be a process or thread, running on one or more processors, in one or more computing devices, executing computer program instructions and interacting with other system components for performing the various functionalities described herein. The computer program instructions are stored in a memory that may be implemented in a computing device using a standard memory device, such as, for example, a random access memory (RAM). The computer program instructions may also be stored in other non-transitory computer readable media such as, for example, a CD-ROM, flash drive, or the like. In addition, a person of skill in the art should recognize that the functionality of various computing devices may be combined or integrated into a single computing device, or the functionality of a particular computing device may be distributed across one or more other computing devices without departing from the scope of the present invention.

A display device 1 and corresponding gate doubling method according to an embodiment of the present invention will now be described with reference to FIG. 1 to FIG. 5.

Referring to FIG. 1, the display device 1 includes a display panel 300, a gate driver 400 and a data driver 500 connected to the display panel 300, and a signal controller 600. The display panel 300 includes a plurality of signal lines and a plurality of pixels PX connected thereto in an equivalent circuit manner. The pixels PX may be arranged substantially in a matrix form. When the display device 1 is a liquid crystal display, the display panel 300 may include at least one substrate and a sealed liquid crystal layer.

The signal lines include a plurality of gate lines G1-Gn for transmitting gate signals and a plurality of data lines D1-Dm for transmitting data voltages Vd. In FIG. 1, the gate lines G1-Gn are extended in a column direction and the data lines D1-Dm are extended in a row direction.

Each pixel PX may include at least one switching element connected to at least one of the data lines D1-Dm and at least one of the gate lines G1-Gn, and at least one pixel electrode connected thereto. The switching element may include at least one thin film transistor, and it may be controlled by gate signals transmitted by at least one of the gate lines G1-Gn to forward at least one data voltage Vd transmitted by the at least one of the data lines D1-Dm to a pixel electrode.

Further, in order to realize color expression, each pixel PX may express one of three or more primary colors (i.e., a spatial division) or may alternately express the primary colors with respect to time (i.e., a temporal division) so that a desired color may be recognized by a spatial or temporal sum of the primary colors.

The signal controller 600 receives input image data IDAT and input control signals ICON from an external device such as a graphics controller and controls driving of the display panel 300. The input image data IDAT have luminance information and the luminance may have a set or predetermined number of gray levels. The input control signals ICON may include a vertical synchronization signal (Vsync), a horizontal synchronizing signal (Hsync), a main clock signal (MCLK), and a data enable signal (DE) in connection with displaying of images. According to another embodiment of the present invention, the input control signals ICON may further include frame rate information.

The signal controller 600 uses the input image data IDAT and the input control signals ICON to process the input image data IDAT according to an operating condition of the display panel 300, to generate output image data DAT, and to generate gate control signals CONTI and data control signals CONT2. The signal controller 600 transmits the gate control signals CONT1 to the gate driver 400, and transmits the data control signals CONT2 and the output image data DAT to the data driver 500.

The signal controller 600 may further include a frame rate controller 650. The frame rate controller 650 controls the frame rate by using the input image data IDAT. The frame rate may be defined to be a number of frames (also called a frame frequency) displayed per second by the display panel 300. The signal controller 600 may generate the gate control signals CONT1 and the data control signals CONT2 according to a determination by the frame rate controller 650. The signal controller 600 may further include a frame memory 660 for storing the input image data IDAT for respective frames.

The gate driver 400 is connected to the gate lines G1-Gn. The gate driver 400 may receive the gate control signals CONT1 from the signal controller 600 and sequentially apply gate signals that are combinations of a gate-on voltage Von and a gate-off voltage Voff (e.g., to generate gate-on voltage pulses) in a row direction for each of at least one gate line G1-Gn.

The gate driver 400 may drive k (k is a natural number greater than one, such as k=2) neighboring ones of the gate lines G1-Gn according to output times of the output image data DAT to apply the gate-on voltage Von to be overlapped for at least a partial time (for example, a portion of a horizontal period, such as half a horizontal period, or a whole horizontal period), and it may apply data voltages Vd corresponding to the output image data DAT to the pixels PX connected to the corresponding gate lines G1-Gn, which is referred to as gate doubling driving and through which a normal charging time of the pixels PX is obtained.

The gate doubling scheme is not restricted to simultaneously driving a pair of gate lines (such as driving a different pair of the gate lines G1-Gn for each horizontal period), and in other embodiments includes a method for simultaneously driving at least three gate lines as a bundle. Compared to this, a method for independently driving the gate lines G1-Gn instead of performing gate doubling driving will be called a gate doubling off driving scheme. A time for applying the gate-on voltage Von to each of the gate lines G1-Gn may be substantially one horizontal period, but is not restricted to this, with the gate-on voltage Von of another one of the gate lines G1-Gn overlapping partially (e.g., a fraction of a horizontal period) or wholly (e.g., an entire horizontal period).

With gate doubling driving, the total scanning time for applying the gate-on voltage Von to all the gate lines G1-Gn of the entire display panel 300 may be reduced to 1/k, e.g., ½ or ⅓, compared to gate doubling off driving, so the frame rate may be increased by k times, e.g., twice or three times.

The data driver 500 is connected to the data lines D1-Dm. The data driver 500 receives output image data DAT and data control signals CONT2 from the signal controller 600, generates data voltages Vd, and applies the data voltages Vd to the data lines D1-Dm. The data voltages Vd may be selected from a plurality of gray level voltages. The data driver 500 may receive entire gray level voltages from an additional gray level voltage generator, or may receive a set or predetermined number of reference gray level voltages to divide and generate the gray level voltages for all the gray levels.

With gate doubling driving, a plurality of neighboring ones of the gate lines G1-Gn are simultaneously driven for at least a partial time (e.g., a partial or entire horizontal period) to transmit the gate-on voltage Von, and for each one of the data lines D1-Dm, the same corresponding data voltage Vd is applied to the corresponding pixels PX connected to the simultaneously driven ones of the gate lines G1-Gn.

With gate doubling driving, the signal controller 600 may generate output image data DAT by compressing the input image data IDAT to have a vertical resolution of 1/k (k is a natural number greater than one representing the number of concurrently driven gate lines G1-Gn, such as two or three) that of using uncompressed output image data, or it may generate the output image data DAT by receiving the input image data IDAT of which its vertical resolution is compressed to be 1/k (e.g., ½ or ⅓) and processing the received input image data IDAT.

For example, the signal controller 600 may extract odd rows or even rows of the input image data IDAT to generate the output image data DAT of which the vertical resolution is compressed to ½ that of gate doubling off driving. The output image data DAT generated by extracting the odd rows of the input image data IDAT are called odd-row compressed data. The output image data DAT generated by extracting the even rows of the input image data IDAT are called even-row compressed data.

In other embodiments, the signal controller 600 may generate compressed output image data DAT by interpolating (such as averaging) the input image data IDAT corresponding to the pixels PX of the at least two neighboring rows. For example, the output image data DAT for one odd row may be found by interpolation, such as an average, of the input image data IDAT of the previous even row and the input image data IDAT of the next even row, which is called odd-row interpolated and compressed data. In a like manner, the output image data DAT for one even row may be found by interpolation, such as an average, of the input image data IDAT of the previous odd row and the input image data IDAT of the next odd row, which is called even-row interpolated and compressed data.

According to another embodiment of the present invention, the signal controller 600 may include the image data generated by compressing the input image data IDAT instead of generating the output image data DAT by compressing the input image data 1DAT of the entire resolution, and in this case, the signal controller 600 may generate the output image data DAT by processing the compressed input image data IDAT according to conditions of the display panel 300 and the data driver 500.

Figure 3:
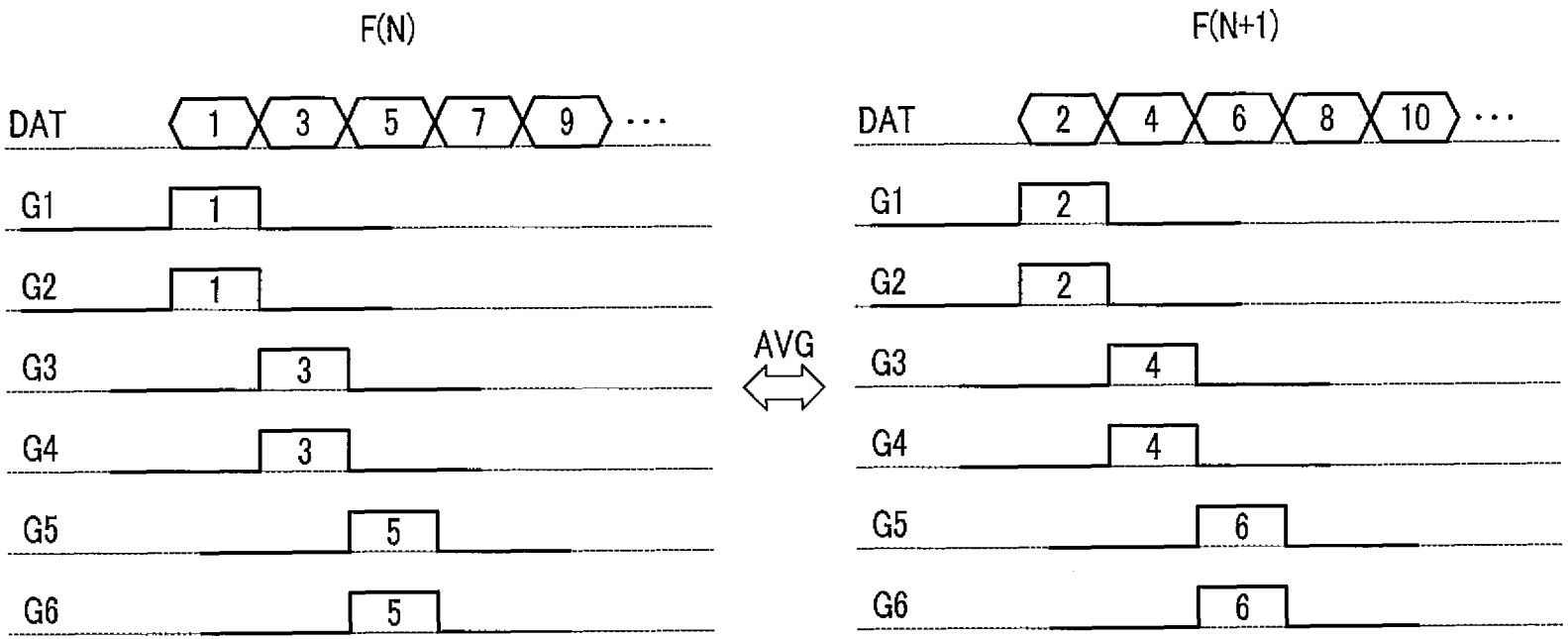
FIG. 3 shows timing diagrams of output image data and gate signals output to a display panel in neighboring frames when a display device is driven by the gate doubling scheme of FIG. 2.

Referring to FIG. 2 and FIG. 3, the method for driving the display device 1 may alternately input the odd-row compressed data (or odd-row interpolated and compressed data) and the even-row compressed data (or even-row interpolated and compressed data) to the data driver 500, and may apply the corresponding data voltages Vd to the pixels PX using gate doubling driving. For ease of description, for these and other illustrations throughout, the first six gate lines G1-G6 are shown and described simply by way of illustration, with reference sometimes made to later gate lines, such as output image data DAT_G7.

For example, regarding the input image data IDAT_G1-IDAT_G6 for the pixels PX respectively connected to the six gate lines G1-G6, data voltages Vd corresponding to the output image data DAT_G1, DAT_G3, and DAT_G5 are applied to the pixel rows connected to the pairs of neighboring gate lines G1 and G2, G3 and G4, and G5 and G6, respectively, in each odd frame F(N). In this instance, for example, the output image data DAT_G1, DAT_G3, and DAT_G5 may be odd-row compressed data (or odd-row interpolated and compressed data) of the input image data IDAT_G1-IDAT_G6.

For example, referring to FIG. 3, data voltages corresponding to the output image data DAT_G1 for the first row are applied to the pixels PX connected to the gate lines G1 and G2, data voltages corresponding to the output image data DAT_G3 for the third row are applied to the pixels PX connected to the gate lines G3 and G4, and data voltages corresponding to the output image data DAT_G5 for the fifth row are applied to the pixels PX connected to the gate lines G5 and G6. It is to be understood that the application of data voltages corresponding to the output image data DAT_G1, DAT_G3, and DAT_G5 may be done concurrently to all of the data lines D1-Dm, each possibly receiving a different data voltage.

In the even frame F(N+1), data voltages corresponding to the output image data DAT_G2, DAT_G4, and DAT_G6 are output to the pixel rows connected to the pairs of neighboring gate lines G1 and G2, G3 and G4, and G5 and G6, respectively, by the data driver 500. In this instance, for example, the output image data DAT_G2, DAT_G4, and DAT_G6 may be even-row compressed data (or even-row interpolated and compressed data) of the input image data IDAT_G1-IDAT_G6.

For example, referring to FIG. 3, data voltages corresponding to the output image data DAT_G2 for the second row are applied to the pixels PX connected to the gate lines G1 and G2, data voltages corresponding to the output image data DAT_G4 for the fourth row are applied to the pixels PX connected to the gate lines G3 and G4, and data voltages corresponding to the output image data DAT_G6 for the sixth row are applied to the pixels PX connected to the gate lines G5 and G6.

For ease of description, the frame F(N) is referred to as an odd frame F(N) and may be an odd-numbered frame, while the next frame F(N+1) is referred to as an even frame F(N+1), but the present invention is not limited thereto. For example, in other embodiments, the parity of the frames F(N) and F(N+1) is reversed.

When the odd frame F(N) and the even frame F(N+1) are alternated, images with luminance temporally averaged for each pixel PX may be observed. For example, the pixels PX connected to the first gate line G1 may display images with substantially the same luminance corresponding to the temporal average (e.g., (DAT_G1+DAT_G2)/2) of the output image data DAT_G1 in the odd frame F(N) and the output image data DAT_G2 in the even frame F(N+1).

Figure 4:
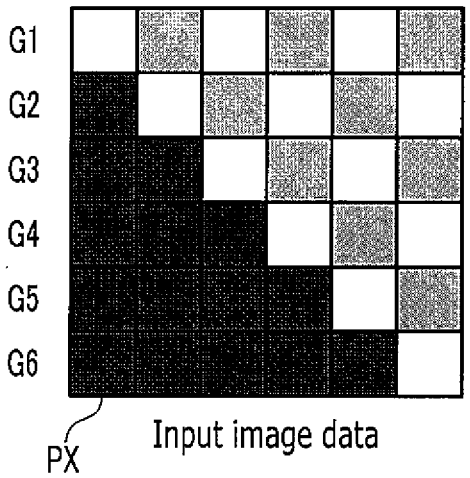
FIG. 4 illustrates input image data that are input to a display device driven by the gate doubling scheme of FIG. 2 and FIG. 3.

As shown in FIG. 4, the image of the gray levels of the input image data IDAT corresponding to the pixels PX connected to the gate lines G1-G6 will be described. When a boundary of an edge of an image includes, for example, a curve (such as a circle) or an oblique angle and is displayed with black and white, the boundary may not be seen as smooth but rather as uneven (such as saw teeth), which is called an aliasing phenomenon.

Figure 5:
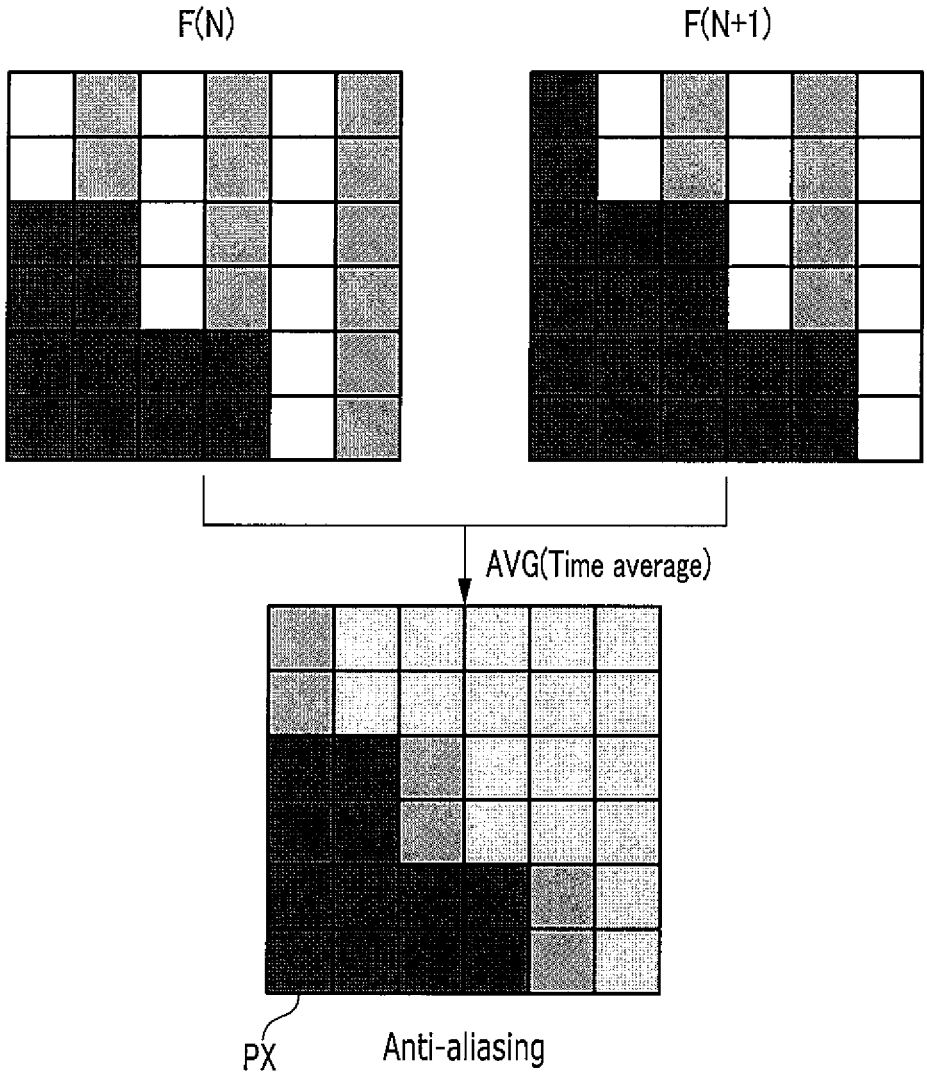
FIG. 5 illustrates images displayed in neighboring frames and as a composite image in a display device driven by the gate doubling scheme of FIG. 2 to FIG. 4.

However, when the image is displayed according to the gate doubling driving method shown in FIG. 2 and FIG. 3 with the input image data 1DAT shown in FIG. 4, the images of the odd frame F(N) and the even frame F(N+1) alternating as shown in FIG. 5 are temporally averaged (AVG) so the edge of the image is observed to be an intermediate gray level (for example, between a gray level of a background image and a gray level of a corresponding image), and an anti-aliasing effect may be obtained. In this instance, the anti-aliasing effect may be performed for each pair of pixels PX as shown in FIG. 5.

According to an embodiment of the present invention, the luminance corresponding to the substantially intermediate value of different gray levels may be recognizable with reference to the boundary of the image through the temporal average of the alternating frames, which may reduce any aliasing, and the images displayed by the odd and even frames F(N) and F(N+1) are odd-row compressed data and even-row compressed data, respectively, which allows displaying the input image data IDAT for each of the pixels PX and observing of high-resolution images.

A display device and corresponding gate doubling method according to another embodiment of the present invention will now be described with reference to FIG. 6 to FIG. 12. The display device and gate doubling method mostly correspond to the above-described display device and gate doubling method, and repeated descriptions may be omitted.

Figure 7:
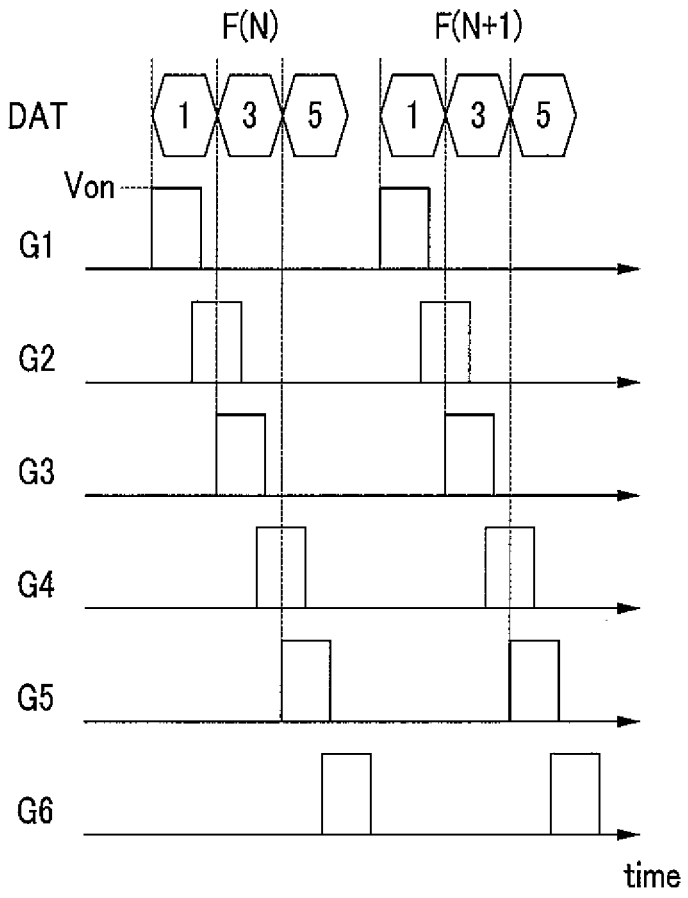
FIG. 7 is a timing diagram of output image data and gate signals output to a display panel in neighboring frames when a display device is driven by the gate doubling scheme of FIG. 6.
Figure 8:
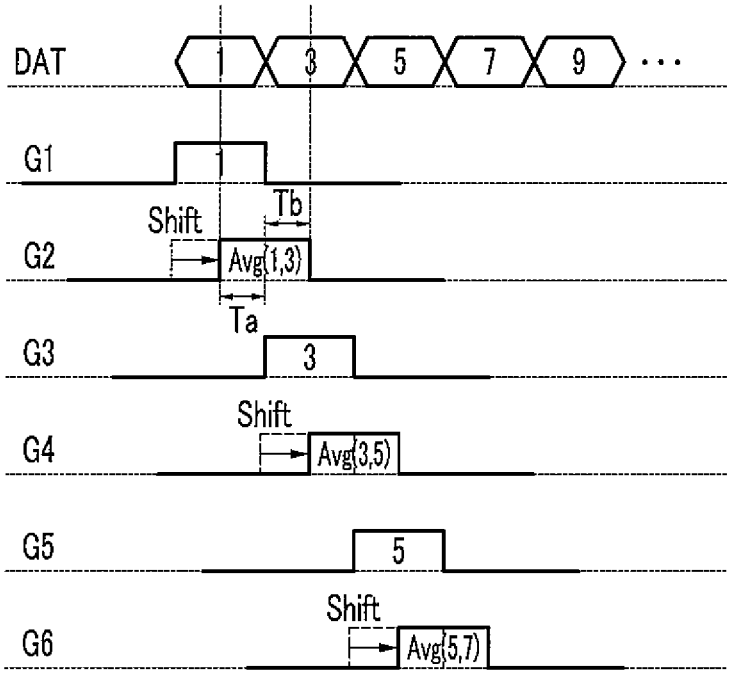
FIG. 8 is a timing diagram of output image data and gate signals output to a display panel for one frame when a display device is driven by the gate doubling scheme of FIG. 6 and FIG. 7.

Referring to FIG. 6 to FIG. 8, the method for driving a display device may provide, for example, odd-row compressed data (or odd-row interpolated and compressed data) or even-row compressed data (or even-row interpolated and compressed data) as the 1/k compressed data to the data driver 500, and may apply the corresponding data voltages Vd to the pixels PX. In the embodiment of FIG. 6 to FIG. 8, the odd-row compressed data are provided to the data driver 500.

In embodiments of the present invention, such as FIG. 6 to FIG. 8, a method for driving a display device performs gate doubling driving for simultaneously driving (at least partially) a plurality (such as two) of neighboring ones of the gate lines G1-Gn, but times for applying the gate-on voltage Von to at least two such ones of the gate lines G1-Gn from among the k neighboring gate lines G1-Gn for transmitting the gate-on voltage Von corresponding to one of the output image data DAT_G1-DAT_G6 may be different from each other (for example, offset but overlapping in part, as illustrated in FIG. 7).

In further detail, a like effect of interpolating the data voltages applied to the pixels PX may be obtained by a timing shift for moving forward or backward the gate-on voltage Von pulses applied to at least part of the k (k is a natural number and is greater than one, such as k=2) gate lines for transmitting the gate-on voltage Von corresponding to one of the output image data DAT_G1-DAT_G6. In this instance, the at least one of the k neighboring gate lines G1-Gn may receive the gate-on voltage Von in synchronization with an output time of the output image data DAT_G1-DAT_G6.

For example, referring to FIG. 6 and FIG. 7, regarding the input image data IDAT_G1-IDAT_G6 for the pixels PX connected to the six gate lines G1-G6, the gate-on voltage Von may be applied to the odd-numbered gate lines G1, G3, and G5 in synchronization with the time for outputting the output image data DAT_G1, DAT_G3, and DAT_G5. However, the gate-on voltage pulses applied to the even-numbered gate lines G2, G4, and G6 are not simultaneously applied to the previous odd-numbered gate lines G1, G3, and G5, which differs from the gate doubling driving of FIG. 2 to FIG. 5, but rather the gate-on voltage pulses move forward in a temporal manner, and may be applied before the time when the gate-on voltage Von starts to be applied to the corresponding next odd-numbered gate lines G3, G5, and G7.

As such, the time for starting to apply the gate-on voltage Von to the even-numbered gate lines G2, G4, and G6 may be provided between the time when the gate-on voltage Von starts to be applied to the odd-numbered gate lines G1, G3, and G5 provided above (e.g., lower odd-numbered gate lines) and the time when the gate-on voltage Von starts to be applied to the odd-numbered gate lines G3, G5, and G7 provided below (e.g., higher odd-numbered gate lines), as shown in FIG. 7 and FIG. 8.

Pulse widths of the gate-on voltage Von applied to the entire gate lines G1-Gn may be substantially the same as each other, but are not limited thereto. The embodiment of FIG. 6 to FIG. 8 features a constant pulse width of the gate-on voltage Von.

Accordingly, in FIG. 6 to FIG. 8, the pixels PX connected to the even-numbered gate lines G2, G4, and G6 receive the data voltages of the output image data DAT_G1, DAT_G3, and DAT_G5, respectively, for the pixels PX of the previous odd-numbered pixel row and the data voltages of the output image data DAT_G3, DAT_G5, and DAT_G7, respectively, for the pixels PX of the next odd-numbered pixel row and that are temporally divided. The output image data DAT_G1, DAT_G3, and DAT_G5 may be, for example, odd-row compressed data (or odd-row interpolated and compressed data) of the input image data IDAT_G1-IDAT_G6.

For example, in FIG. 6 to FIG. 8, the pixels PX connected to the second gate line G2 receive the data voltages Vd of the output image data DAT_G1 for the pixels PX connected to the first gate line G1 and the data voltages Vd of the output image data DAT_G3 for the pixels PX connected to the third gate line G3 and that are temporally divided (e.g., a portion of time for receiving the data voltages Vd corresponding to the output image data DAT_G1 followed by a portion of time for receiving the data voltages corresponding to the output image data DAT_G3).

Therefore, the pixels PX connected to the second gate line G2 may be charged with data voltages corresponding to values between those provided for the two output image data DAT_G1 and DAT_G3. For example, the pixels PX connected to the second gate line G2 may display the image with luminance that corresponds to the value generated by temporally interpolating (e.g., averaging) the output image data DAT_G1 and DAT_G3.

FIG. 6 shows a temporal average (e.g., the arithmetic average (DAT_G1+DAT_G3)/2), as an example of interpolation, denoted Avg(DAT_G1, DAT_G3), but it may be a value other than the arithmetic average of the output image data DAT_G1 and DAT_G3, such as another interpolation value according to a timing shift amount of the gate signals.

As shown in FIG. 8, a ratio of an overlapping section Ta to a non-overlapping section Tb by the gate-on voltage pulses applied to the even-numbered gate lines G2, G4, and G6 over the gate-on voltage pulses applied to the immediately preceding odd-numbered gate lines G1, G3, and G5 may be appropriately controlled. When a weight value of W1:W2 is to be imparted to the output image data DAT of the previous odd-numbered row and the output image data DAT of the next odd-numbered row so that the corresponding pixels PX may reach target voltages, the ratio of the overlapping section Ta to the non-overlapping section Tb may also be substantially W1:W2. For example, when a temporal interpolation value of the data voltages Vd is the arithmetic average value, the ratio of Ta to Tb may be substantially 1:1.

Figure 9:
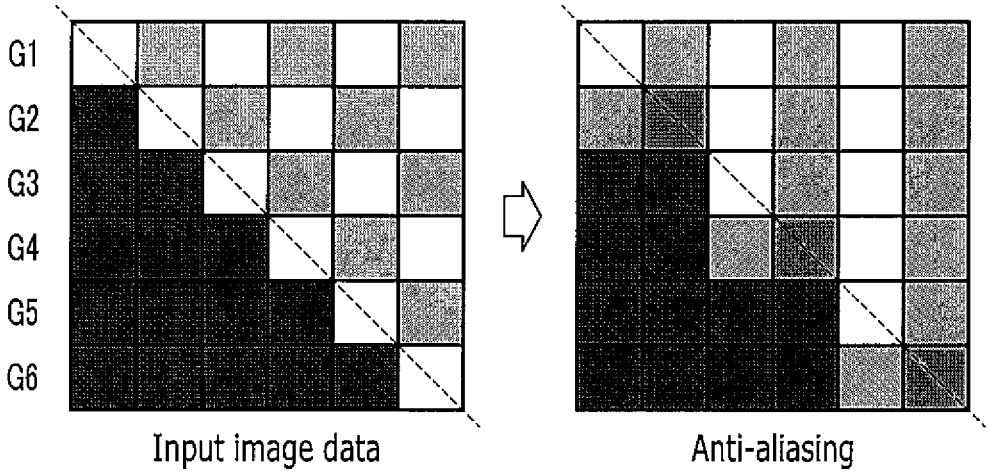
FIG. 9 shows input image data that are input to a display device and an image displayed by a display device driven by the gate doubling scheme of FIG. 6 to FIG. 8.
Figure 10:
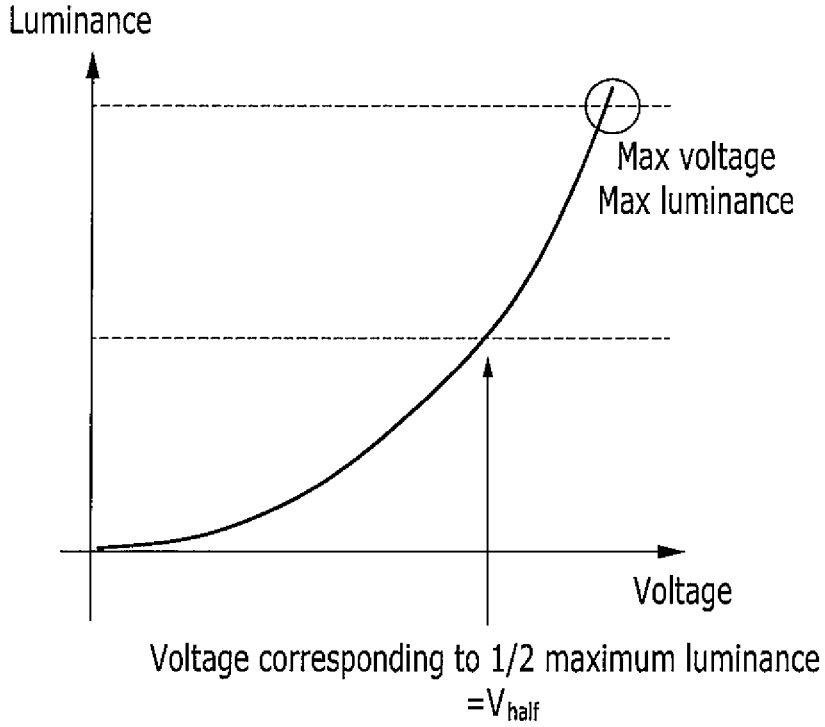
FIG. 10 is a graph of the change of luminance with respect to the voltage applied to a pixel of a display device according to an embodiment of the present invention.

As shown in FIG. 9, when the boundary of the edge of the image is input image data IDAT configured with black and white and the image is displayed according to a driving method shown in FIG. 6 to FIG. 8, the pixels PX connected to the even-numbered gate lines G2, G4, and G6 are charged with voltages that correspond to the interpolation values of the output image data DAT for the pixels PX connected to the previous odd-numbered gate lines G1, G3, and G5 and the next odd-numbered gate lines G3, G5, and G7. Therefore, a region filled with luminance corresponding to substantial intermediate values of different gray levels and is generated on the edge of the image. Accordingly, the anti-aliasing effect may be obtained, the image may be made smooth, and the pixels PX do not appear to stand out so the user may see high resolution.

Here, the anti-aliasing effect may be obtained for each pixel PX in spite of the gate doubling driving, as shown in FIG. 9. Further, the pixels PX connected to the even-numbered gate lines G2, G4, and G6 are charged with voltages corresponding to the interpolation values of at least two output image data DAT according to interpolation driving by a timing shift of the gate signals applied to the even-numbered gate linesG2, G4, and G6, which may upscale the output image data DAT and display high-resolution images.

The shift of the gate signals applied to the even-numbered gate lines G2, G4, and G6 has been described in the present embodiment, and without being restricted to this, in other embodiments, the pixels PX connected to the odd-numbered gate lines G1, G3, and G5 may be charged with the voltages caused by temporal interpolation by temporally backward shifting the pulses of the gate-on voltages applied to the odd-numbered gate lines G1, G3, and G5.

A method for determining the described ratio of an overlapping section Ta to a non-overlapping section Tb by the gate-on voltage pulses applied to the even-numbered gate lines G2, G4, and G6 with the gate-on voltage pulses applied to the previous odd-numbered gate lines G1, G3, and G5 will now be described with reference to FIG. 6 to FIG. 8 and FIG. 10 to FIG. 12.

For ease of description, it will be assumed that the two output image data DAT that are temporally divided and applied to the pixels PX through the shift of the gate signals applied to the even-numbered gate lines G2, G4, and G6 correspond to a white gray level and a black gray level. As such, it suffices to determine for the pixels PX connected to the even-numbered gate lines G2, G4, and G6 the overlapping section Ta of the gate signals to express substantially half the luminance of the white gray level. For this purpose, referring to FIG. 10, a half voltage Vhalf corresponding to substantially the half of the maximum luminance of the white gray level is found.

Figure 11:
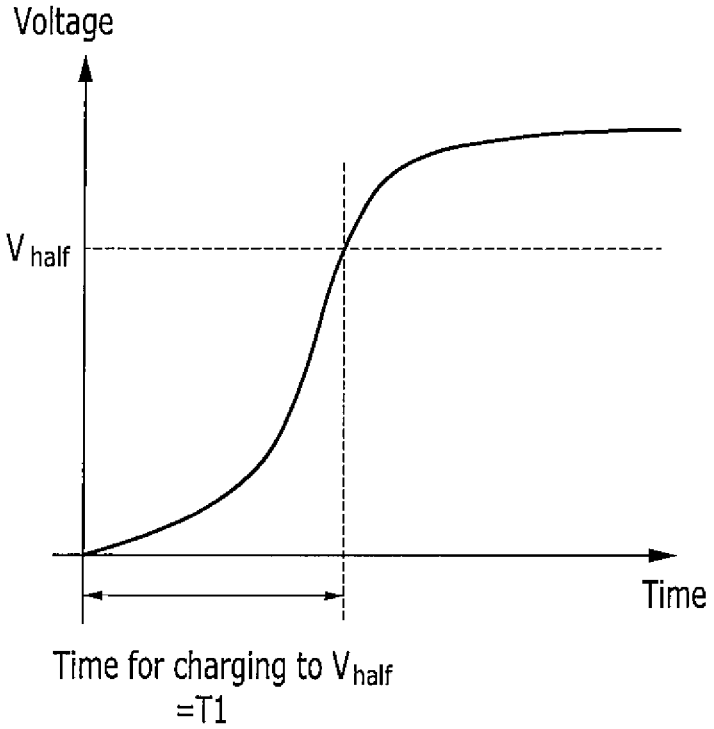
FIG. 11 is a graph of the charging voltage with respect to time when a pixel of a display device displays a black gray level in a previous frame and then receives a voltage of image data of a white gray level according to an embodiment of the present invention.

Referring to FIG. 11, when the pixels PX of a display device display an image with the black gray level in the previous frame and apply a data voltage corresponding to the white gray level to the pixels PX in the present frame, a half charging time T1 for charging the pixels PX until the voltage Vhalf is found by using a graph of a charging voltage with respect to time.

Figure 12:
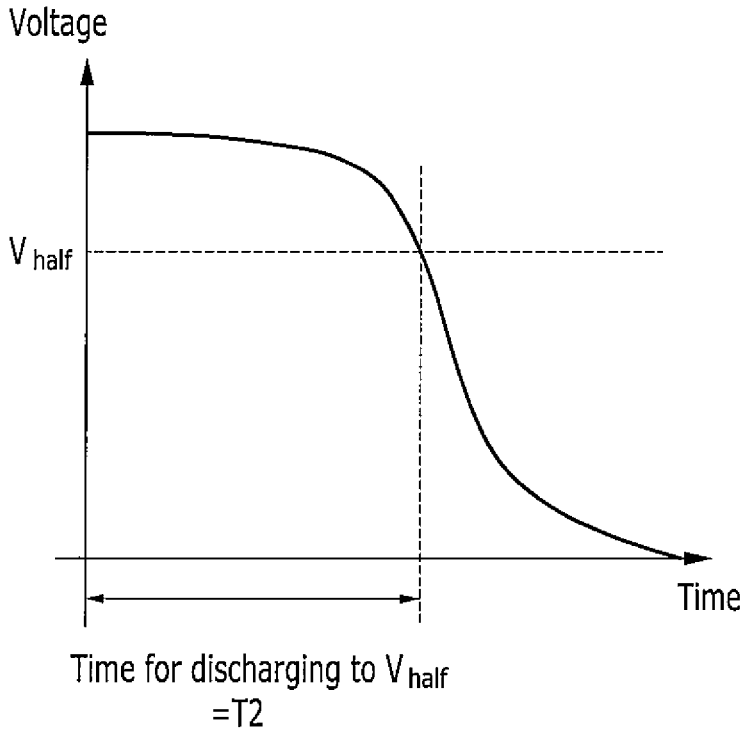
FIG. 12 is a graph of the charging voltage with respect to time when a pixel of a display device displays a white gray level in a previous frame and receives a voltage of image data of a black gray level according to an embodiment of the present invention.

In a like manner, referring to FIG. 12, when the pixels PX display an image with the white gray level in the previous frame and apply a data voltage corresponding to the black gray level to the pixel PX in the present frame, a half discharging time T2 for discharging the pixels PX until the voltage Vhalf is found by using a graph of a charging voltage with respect to time. The half charging time T1 and the half discharging time T2 are changeable according to the condition of the display device 1.

The ratio of the overlapping section Ta to the non-overlapping section Tb may be found so that the pixels PX connected to the even-numbered gate lines G2, G4, and G6 display substantially half the luminance of the white gray level and may be determined by using the half charging time T1 and the half discharging time T2 found from FIG. 11 and FIG. 12. For example, when the output image data DAT_G1 for the pixels PX connected to the first gate line G1 have the white gray level and the output image data DAT_G3 for the pixels PX connected to the third gate line G3 have the black gray level, the ratio of the overlapping section Ta to the non-overlapping section Tb of the gate-on voltage pulse applied to the second gate line G2 may be substantially equal to the ratio of the half charging time T1 to the half discharging time T2.

Likewise, when the output image data DAT_G1 for the pixels PX connected to the first gate line G1 have the black gray level and the output image data DAT_G3 for the pixels PX connected to the third gate line G3 have the white gray level, the ratio of the overlapping section Ta to the non-overlapping section Tb of the gate-on voltage pulse applied to the second gate line G2 may be substantially equal to the ratio of the half discharging time T2 to the half charging time T1.

A display device and corresponding gate doubling method according to yet another embodiment of the present invention will now be described with reference to FIG. 13 to FIG. 17. The display device and gate doubling method mostly correspond to the above-described display devices and gate doubling methods, so repeated descriptions may be omitted.

Figure 14:
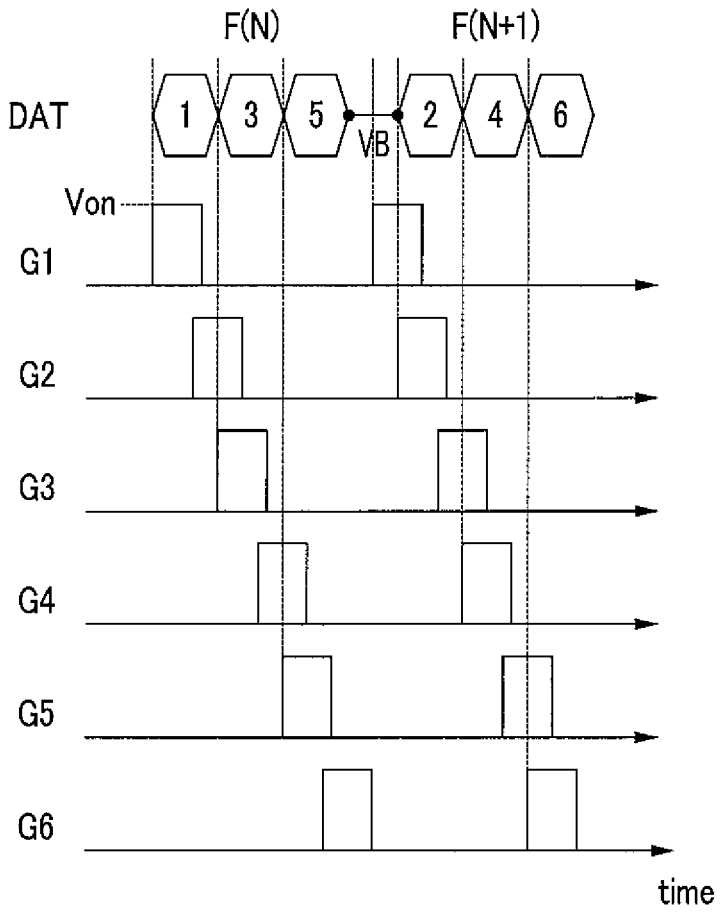
FIG. 14 and FIG. 15 are timing diagrams of output image data and gate signals output to a display panel in neighboring frames when a display device is driven by the gate doubling scheme of FIG. 13.
Figure 15:
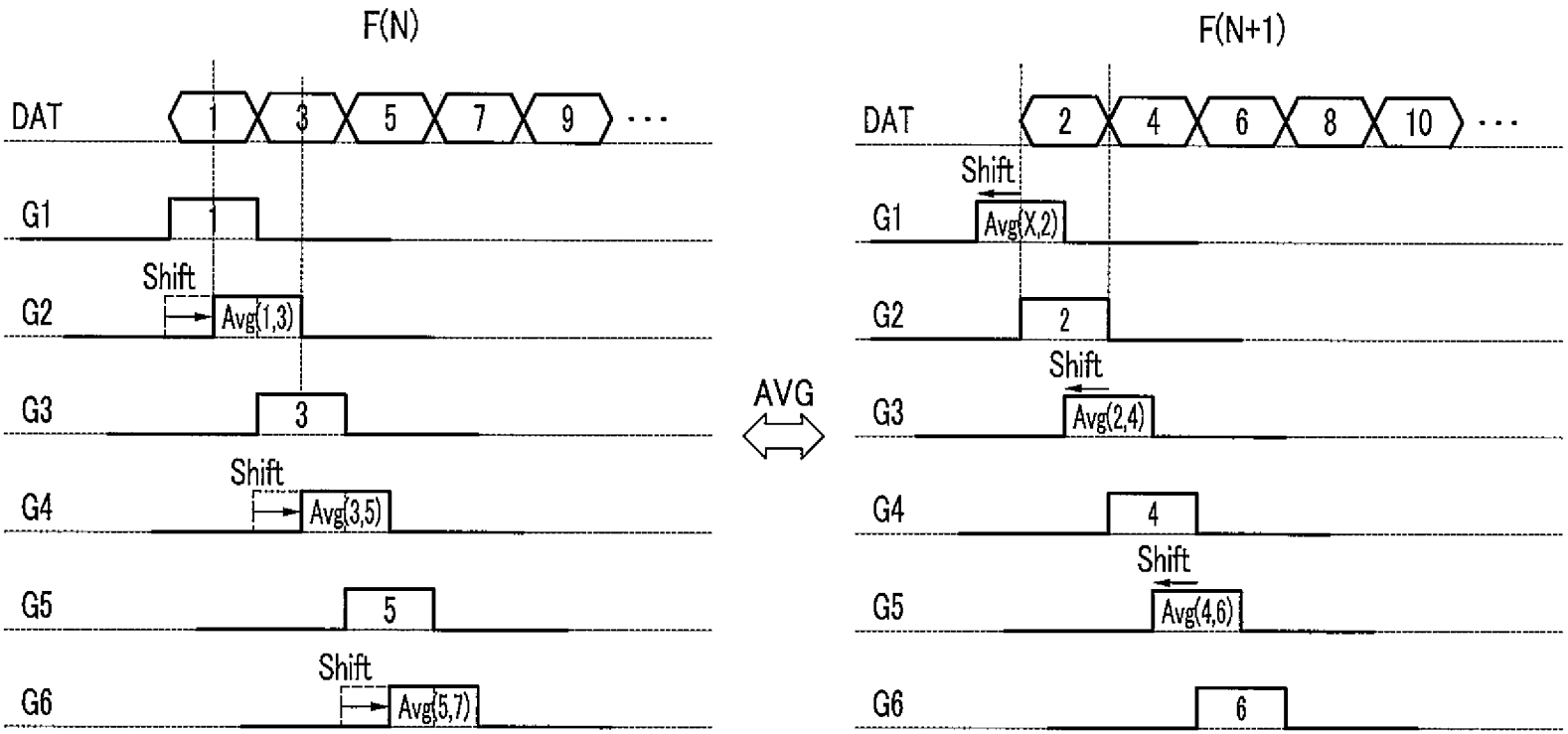

Referring to the gate doubling method of FIG. 13 to FIG. 15, the odd-row compressed data (or odd-row interpolated and compressed data) and the even-row compressed data (or even-row interpolated and compressed data) are alternated and input to the data driver 500, and corresponding data voltages Vd are applied to the pixels PX, which corresponds to the embodiment described above with reference to FIG. 2 and FIG. 3.

For example, in FIG. 13 to FIG. 15, regarding the input image data IDAT_G1-IDAT_G6, data voltages of the output image data DAT_G1, DAT_G3, and DAT_G5 that are odd-row compressed data (or odd-row interpolated and compressed data) are sequentially input for one odd frame F(N), and output image data DAT_G2, DAT_G4, and DAT_G6 that are even-row compressed-data (or even-row interpolated and compressed data) are sequentially input for the even frame F(N+1). A vertical blank section VB to which no output image data DAT (for example, black gray level output image data, which may also be labeled X in this specification or drawings) are input is provided between the neighboring frames F(N) and F(N+1), for instance, to suppress any influence of output image data DAT intended for high-numbered gate lines in one frame on the low-numbered gate lines for the next frame.

In the gate doubling driving of FIG. 13 to FIG. 15, the driving will mostly correspond to the embodiment described with reference to FIG. 6 to FIG. 12 in the odd frame F(N). In further detail, a starting point for applying the gate-on voltage pulses applied to the even-numbered gate lines G2, G4, and G6 is between a point for starting to apply the gate-on voltage Von to the previous odd-numbered gate lines G1, G3, and G5 and a point for starting to apply the gate-on voltage Von to the next odd-numbered gate lines G3, G5, and G7.

In the even frame F(N+1), the starting point for applying the gate-on voltage pulses applied to the odd-numbered gate lines G1, G3, and G5 is shifted backward to be provided between a point for starting to apply the gate-on voltage Von to the previous even-numbered gate lines G2 and G4 (and the vertical blank section VB) and a point for starting to apply the gate-on voltage Von to the next even-numbered gate lines G2, G4, and G6. The odd frame F(N) processing and the even frame F(N+1) processing may be alternated and continued in this fashion.

Accordingly, as illustrated in FIG. 15, in the odd frame F(N) in which the odd-row compressed data (or odd-row interpolated and compressed data) are input, the data voltages of the originally corresponding output image data DAT_G1, DAT_G3, and DAT_G5 are applied to the pixels PX connected to the odd-numbered gate lines G1, G3, and G5, and the data voltages of the output image data DAT_G1, DAT_G3, and DAT_G5 for the pixels PX of the previous odd-numbered pixel row and the data voltages of the output image data DAT_G3, DAT_G5, and DAT_G7 for the pixels PX of the next odd-numbered pixel row are temporally divided and are applied to the pixels PX connected to the even-numbered gate lines G2, G4, and G6, so the pixels PX connected to the even-numbered gate lines G2, G4, and G6 may be charged with data voltages corresponding to values between the corresponding two output image data.

Further, in the even frame F(N+1) in which even-row compressed data (or even-row interpolated and compressed data) are input, the data voltage of the originally corresponding output image data DAT_G2, DAT_G4, and DAT_G6 is applied to the pixels PX connected to the even-numbered gate lines G2, G4, and G6, and the data voltage of the output image data DAT_G2 and DAT_G4 (and X) for the pixels PX of the previous even-numbered pixel row (and the vertical blank section VB) and the data voltage of the output image data DAT_G2, DAT_G4, and DAT_G6 for the pixels PX of the next even-numbered pixel row are temporally divided and are applied to the pixels PX connected to the odd-numbered gate lines G1, G3, and G5, so each of the pixels PX connected to the odd-numbered gate lines G1, G3, and G5 may be charged with data voltages corresponding to values between the corresponding two output image data.

As shown in FIG. 13 and FIG. 14, in the even frame F(N+1), a section for applying the gate-on voltage Von to the first gate line G1 partially overlaps the vertical blank section VB (corresponding to output image data X) and the section corresponding to output image data DAT_G2, so the temporally interpolated voltage applied to the pixels PX connected to the first gate line G1 in the even frame F(N+1) may be less than (e.g., ½) the output image data DAT_G2, such as Avg(X,DAT_G2) or ½ DAT_G2.

When the odd frame F(N) and the even frame F(N+1) are alternated, the voltages substantially applied to the pixels PX connected to an i-th gate line Gi may substantially correspond to voltages that correspond to values generated by interpolating the originally corresponding output image data DAT_Gi, the output image data DAT_Gi−1 corresponding to the pixels PX connected to the previous gate line Gi−1, and the output image data DAT_Gi+1 corresponding to the pixels PX connected to the next gate line Gi+1. In further detail, referring to FIG. 13, the voltages substantially applied to the pixels PX connected to the i-th gate line Gi may substantially correspond to voltages generated by imparting weight values of 2, 1, and 1 to the output image data DAT_Gi, the output image data DAT_Gi−1 corresponding to the pixels PX connected to the previous gate line Gi−1, and the output image data DAT_Gi+1 corresponding to the pixels PX connected to the next gate line Gi+1, and averaging them with these corresponding weight values, as shown in FIG. 13 (rightmost column).

Accordingly, a similar or substantially the same result as receiving the data voltages of the output image data DAT with gate doubling off driving may be obtained with gate doubling driving by applying a filter of 0.25:0.5:0.25 to the output image data DAT corresponding to the pixels connected to the previous gate line, the pixels connected to the corresponding gate line, and the pixels connected to the next gate line.

In addition to this, various features of the above-described embodiments are applicable to the present embodiment in an equivalent manner. For example, the ratio of the overlapping section Ta to the non-overlapping section Tb when the gate-on voltage Von applied to the even-numbered gate lines G2, G4, and G6 or the odd-numbered gate lines G1, G3, and G5 shifts to overlap the gate-on voltage pulse of the previous gate lines G1-Gn may be determined in a like manner to the above-described embodiments.

Figure 16:
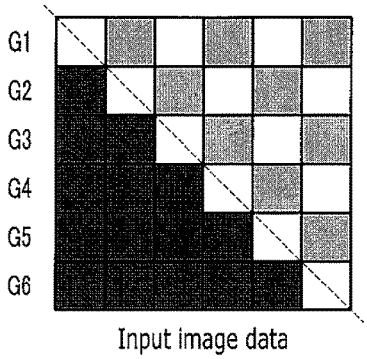
FIG. 16 shows input image data that are input to a display device driven by the gate doubling scheme of FIG. 13 to FIG. 15.
Figure 17:
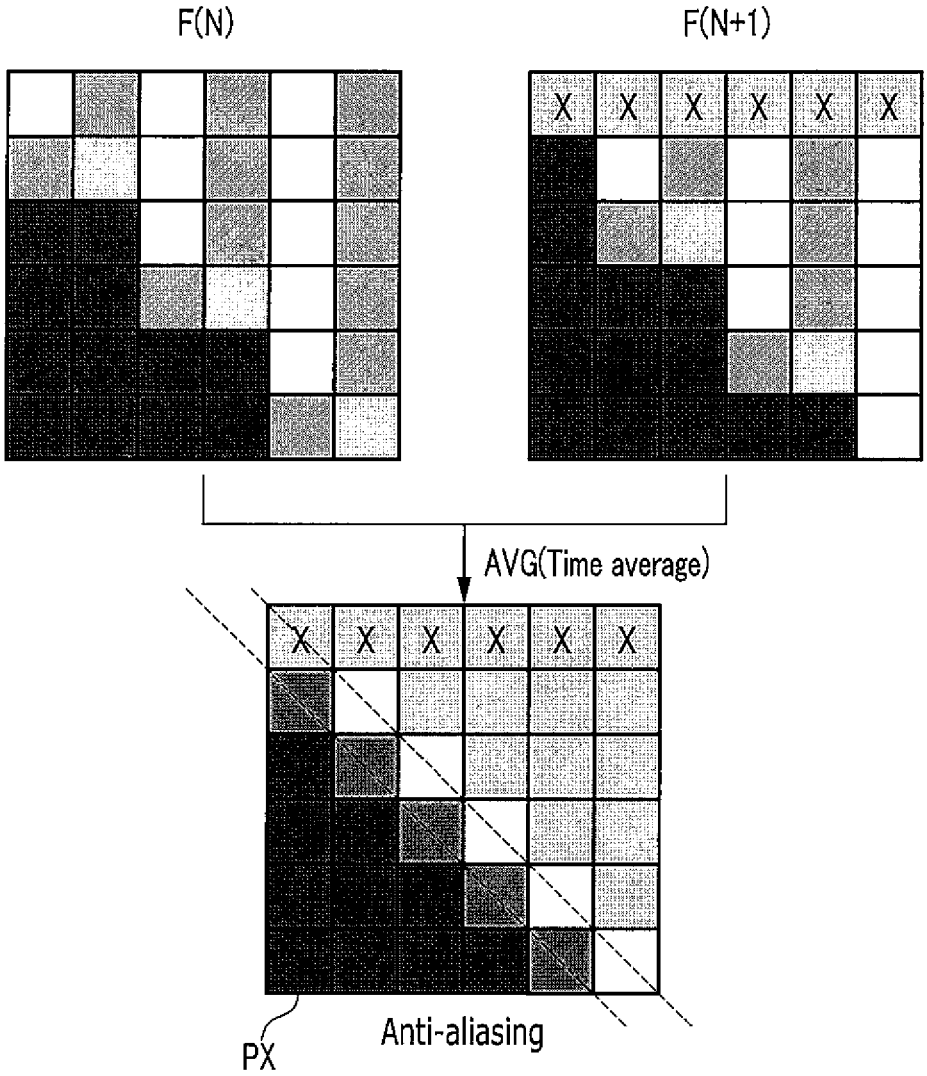
FIG. 17 shows an image displayed in neighboring frames and as a composite image in a display device driven by the gate doubling scheme of FIG. 13 to FIG. 16.

As shown in FIG. 16, the image of the gray levels of the corresponding input image data IDAT is illustrated in the pixels PX connected to the gate lines G1-G6, and as shown in FIG. 17, the anti-aliasing effect is obtained by the odd and even frames F(N) and F(N+1) to allow smooth images and visually high resolution according to the driving method according to the present embodiment. Further, the data voltages of the entire output image data DAT with may be applied to obtain high-resolution images.

A display device and corresponding gate doubling method according to still yet another embodiment of the present invention will now be described with reference to FIG. 18 to FIG. 21.

Figure 19:
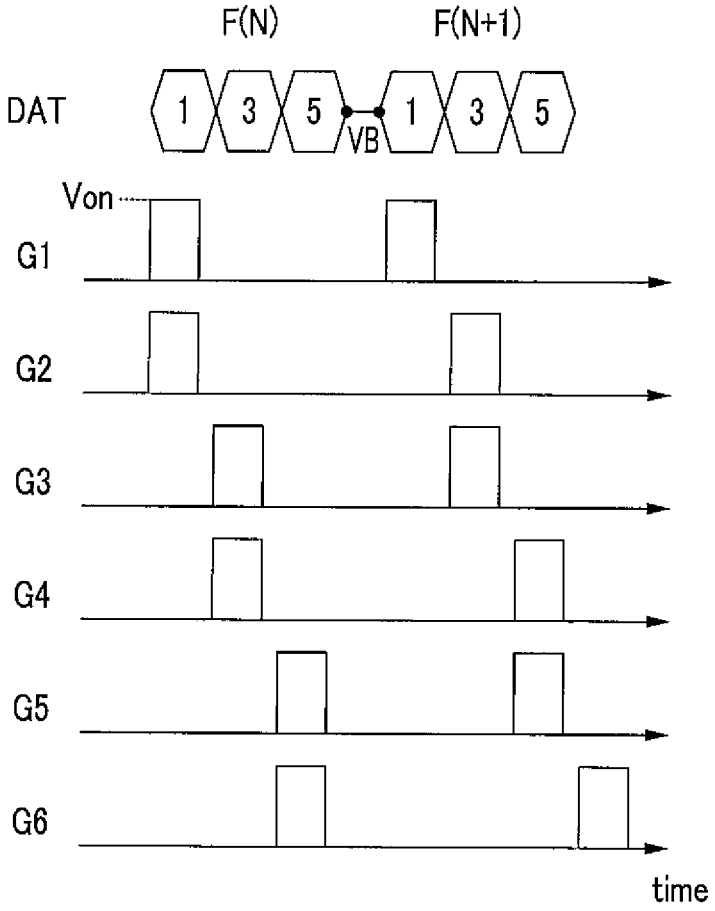
FIG. 19 and FIG. 20 are timing diagrams of output image data and gate signals output to a display panel in neighboring frames when a display device is driven by the gate doubling scheme of FIG. 18.
Figure 20:
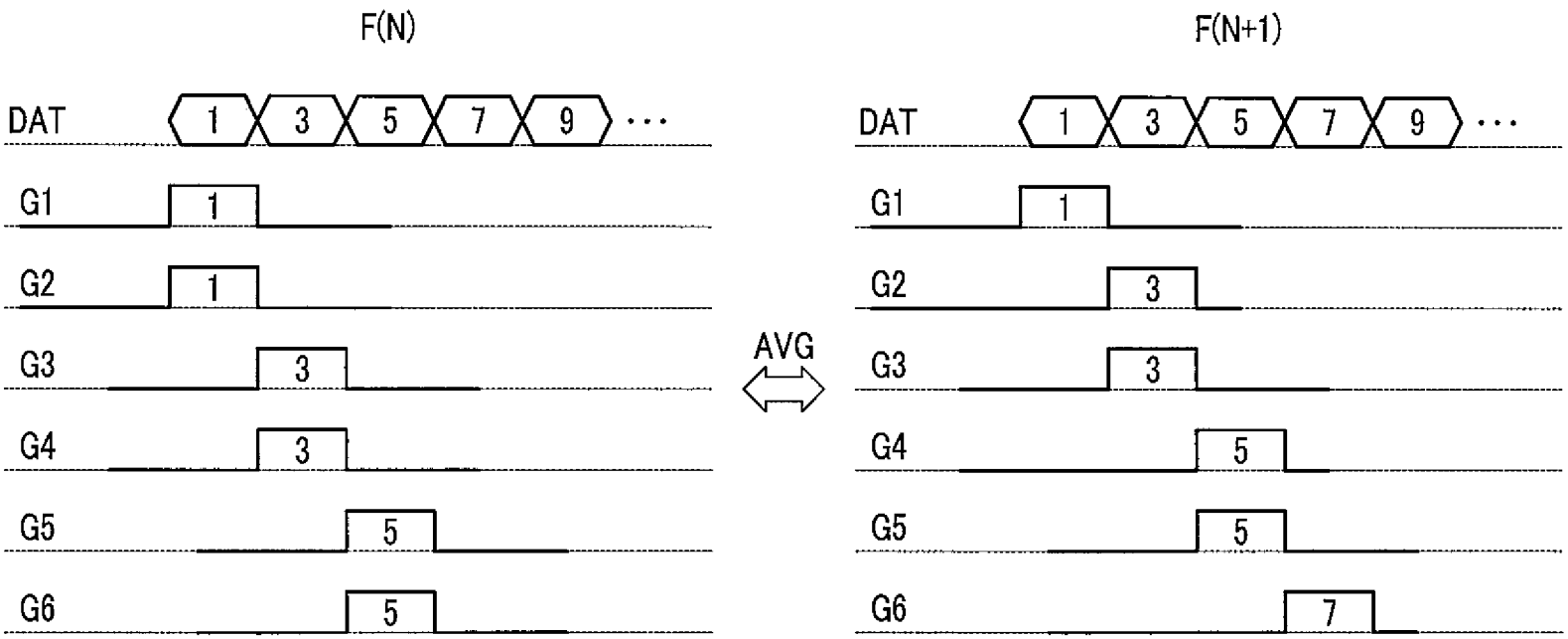

Referring to FIG. 18 to FIG. 20, the method for driving a display device may apply the compressed output image data DAT, such as odd-row compressed data (or odd-row interpolated and compressed data) or even-row compressed data (or even-row interpolated and compressed data) to the data driver 500, and may apply the corresponding data voltages Vd to the pixels PX. In the embodiment of FIG. 18 to FIG. 20, the odd-row compressed data are output to the data driver 500.

The method for driving a display device uses gate doubling driving for simultaneously driving a plurality of neighboring ones of the gate lines G1-Gn, and k such neighboring ones of the gate lines G1-Gn for transmitting the gate-on voltage pulse corresponding to one of the output image data DAT_G1-DAT_G6 may be charged for each frame and column of pixels. In further detail, part of the k neighboring ones of the gate lines G1-Gn for transmitting the gate-on voltage pulse corresponding to one of the output image data DAT_G1-DAT_G6 transmit the gate-on voltage pulse corresponding to the previous output image data and part of the k gate lines transmit the gate-on voltage pulse corresponding to the next output image data in the next frame.

For example, the k ones of the gate lines G1-Gn driven corresponding to one of the output image data DAT_G3 may be the third gate line G3 and the fourth gate line G4 in the odd frame F(N) and may be the second gate line G2 and the third gate line G3 in the even frame F(N+1).

In further detail, the time for applying the gate-on voltage pulse to the even-numbered gate lines G2, G4, and G6 becomes simultaneous with the time for applying the gate-on voltage pulse to the previous odd-numbered gate lines G1, G3, and G5 in the odd frame F(N), and becomes simultaneous with the time for applying the gate-on voltage pulse to the next odd-numbered gate lines G3, G5, and G7 in the even frame F(N+1), and the two frames F(N), F(N+1) are alternated and driven. As shown in FIG. 18, the pixels PX connected to the even-numbered gate lines G2, G4, and G6 express the same average luminance as that charged with the interpolated value of the output image data DAT_G1, DAT_G3, and DAT_G5 corresponding to the pixels PX connected to the gate lines G1, G3, and G5 of the previous odd row and the output image data DAT_G3, DAT_G5, and DAT_G7 corresponding to the pixels PX connected to the gate lines G3, G5, and G7 of the next odd row, for example, the averaged value.

For example, the pixels PX connected to the second gate line G2 may indicate the image of substantially the same luminance as receiving of the temporal average (such as DAT_G1+DAT_G3)/2) of the data voltages Vd of the output image data DAT_G1 received in the odd frame F(N) and the data voltages Vd of the output image data DAT_G3 applied in the even frame F(N+1).

After the temporal averaging, the pixels PX connected to the odd-numbered gate lines G1, G3, and G5 are charged with data voltages corresponding to the output image data DAT_G1, DAT_G3, and DAT_G5.

The case in which the time for applying the gate-on voltage pulse applied to the even-numbered gate lines G2, G4, and G6 is alternated for each frame has been described in the present embodiment, and without being restricted to this, in other embodiments, the time for applying the gate-on voltage pulse applied to the odd-numbered gate lines G1, G3, and G5 may be alternated for each frame.

According to the present embodiment, a similar effect of anti-aliasing the image for which the vertical resolution is reduced to 1/k (e.g., ½) by gate doubling driving for each frame in a vertical manner for each pixel PX is obtained.

Figure 21:
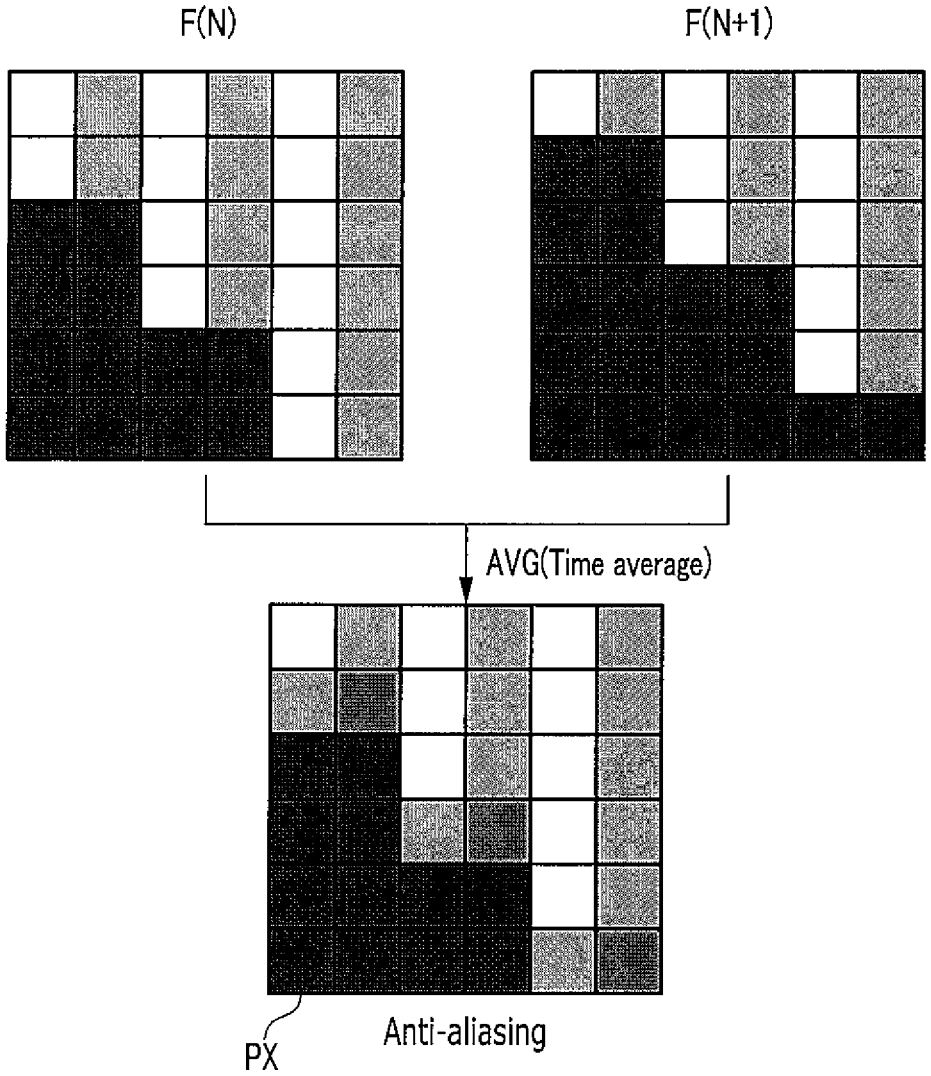
FIG. 21 illustrates images displayed in neighboring frames and as a composite image in a display device driven by the gate doubling scheme of FIG. 18 to FIG. 20.

Referring to FIG. 21, when the image for the input image data IDAT as shown in FIG. 16 is displayed, according to the driving method according to the present embodiment, the image of the odd and even frames F(N) and F(N+1) are temporally averaged (AVG) to obtain the anti-aliasing effect and visually high resolution.

A display device and corresponding gate doubling method according to still another embodiment of the present invention will now be described with reference to FIG. 22 to FIG. 25.

Figure 23:
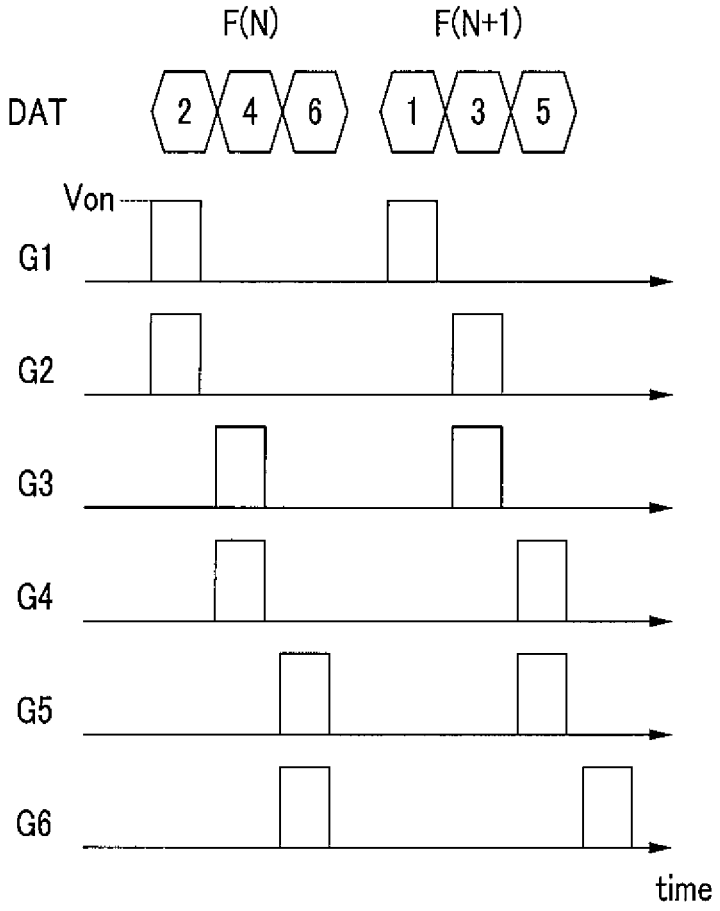
FIG. 23 and FIG. 24 are timing diagrams of output image data and gate signals output to a display panel in neighboring frames when a display device is driven by the gate doubling scheme of FIG. 22.
Figure 24:
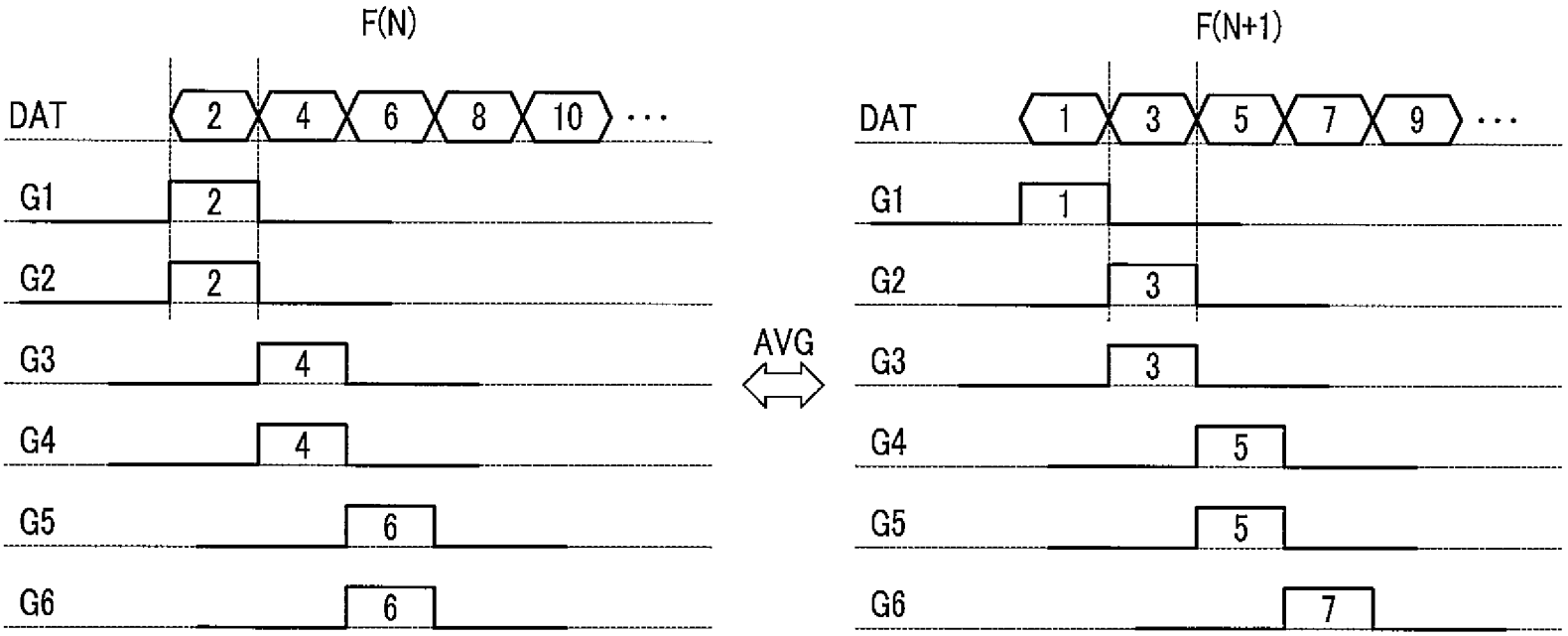

Referring to FIG. 22 to FIG. 24, the method for driving a display device 1 may alternate the odd-row compressed data (or odd-row interpolated and compressed data) and the even-row compressed data (or even-row interpolated and compressed data) using gate doubling driving, may input them to the data driver 500, and may apply the corresponding data voltage Vd to the pixels PX. For example, the odd-row compressed data (or odd-row interpolated and compressed data) may be sequentially input in the odd frame F(N), and the even-row compressed data (or even-row interpolated and compressed data) may be sequentially input in the even frame F(N+1).

The method for driving the gate lines G1-Gn mostly corresponds to the embodiment described with reference to FIG. 18 to FIG. 21. For example, the method performs gate doubling driving for simultaneously driving a plurality of neighboring gate lines G1-Gn, the time for applying the gate-on voltage pulse to the even-numbered gate lines G2, G4, and G6 becomes simultaneous with the time for applying the gate-on voltage pulse to the previous odd-numbered gate lines G1, G3, and G5 in the odd frame F(N), it becomes simultaneous with the time for applying the gate-on voltage pulse to the next odd-numbered gate lines G1, G3, and G5 in the even frame F(N+1), and the two frames F(N) and F(N+1) are alternated and driven.

By visual interpolation, as shown in FIG. 22, the pixels PX connected to the gate lines G1, G2, . . . , may express the same average luminance as that charged with the interpolated value of the corresponding output image data and the output image data corresponding to the pixels PX connected to the gate lines G2, G3, . . . , of the next row, for example, the averaged value.

Figure 25:
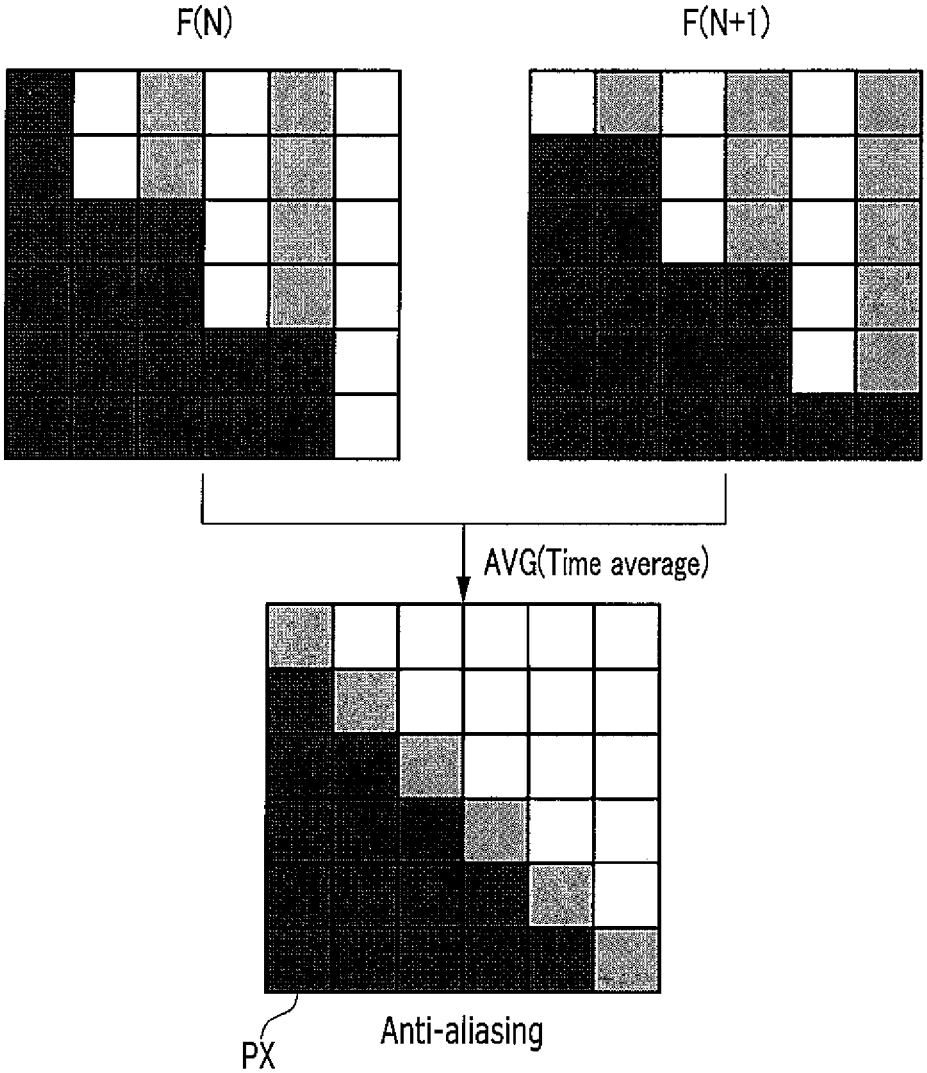
FIG. 25 illustrates images displayed in neighboring frames and as a composite image in a display device driven by the gate doubling scheme of FIG. 22 to FIG. 24.

According to this, the effect of increasing resolution is obtained by the temporal interpolation effect caused by alternating the frames F(N) and F(N+1). Referring to FIG. 25, when the image for the input image data IDAT as shown in FIG. 16 is displayed, the image of the alternating frames F(N) and F(N+1) are temporally averaged (AVG) to obtain the anti-aliasing effect and visually high resolution. Further, a similar effect of anti-aliasing the image for which the vertical resolution is reduced to ½ by the gate doubling driving for each frame in a vertical manner for each pixel PX is obtained.

The image displayed by the odd and even frames F(N) and F(N+1) is the odd-row compressed data and the even-row compressed data, respectively, thereby displaying the entire input image data IDAT of the entire pixels PX, displaying high-resolution images, and improving image quality. Accordingly, a similar or substantially the same result as receiving the data voltages of the output image data DAT with gate doubling off driving may be obtained with gate doubling driving by applying a filter of 0.5:0.5 to the output image data DAT corresponding to the pixels connected to the corresponding gate line and the pixels connected to the next gate line.

Figure 27:
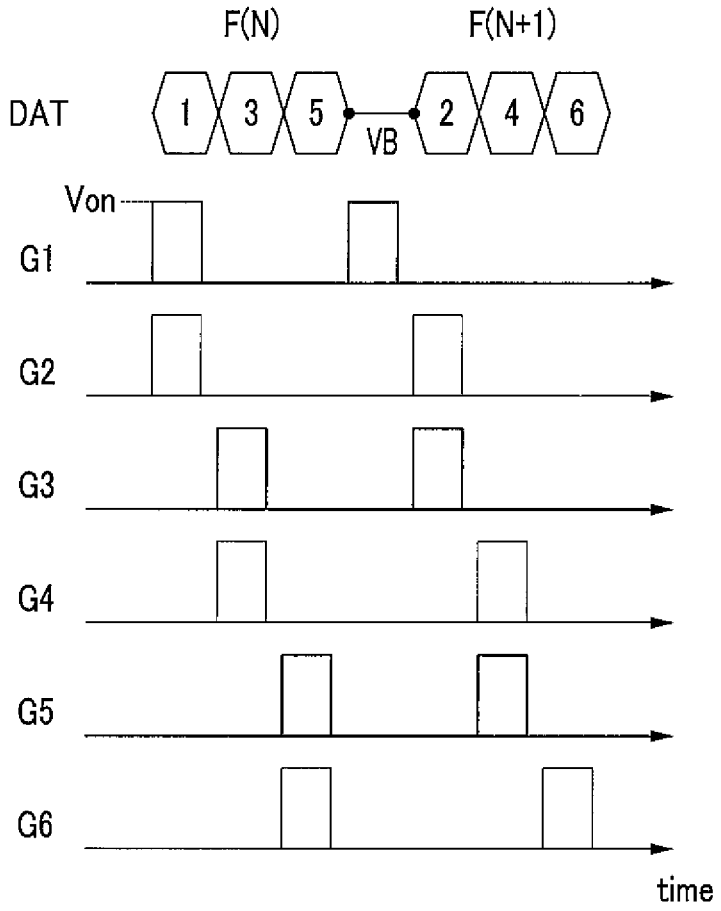
FIG. 27 and FIG. 28 are timing diagrams of output image data and gate signals output to a display panel in neighboring frames when a display device is driven by the gate doubling scheme of FIG. 26.
Figure 28:
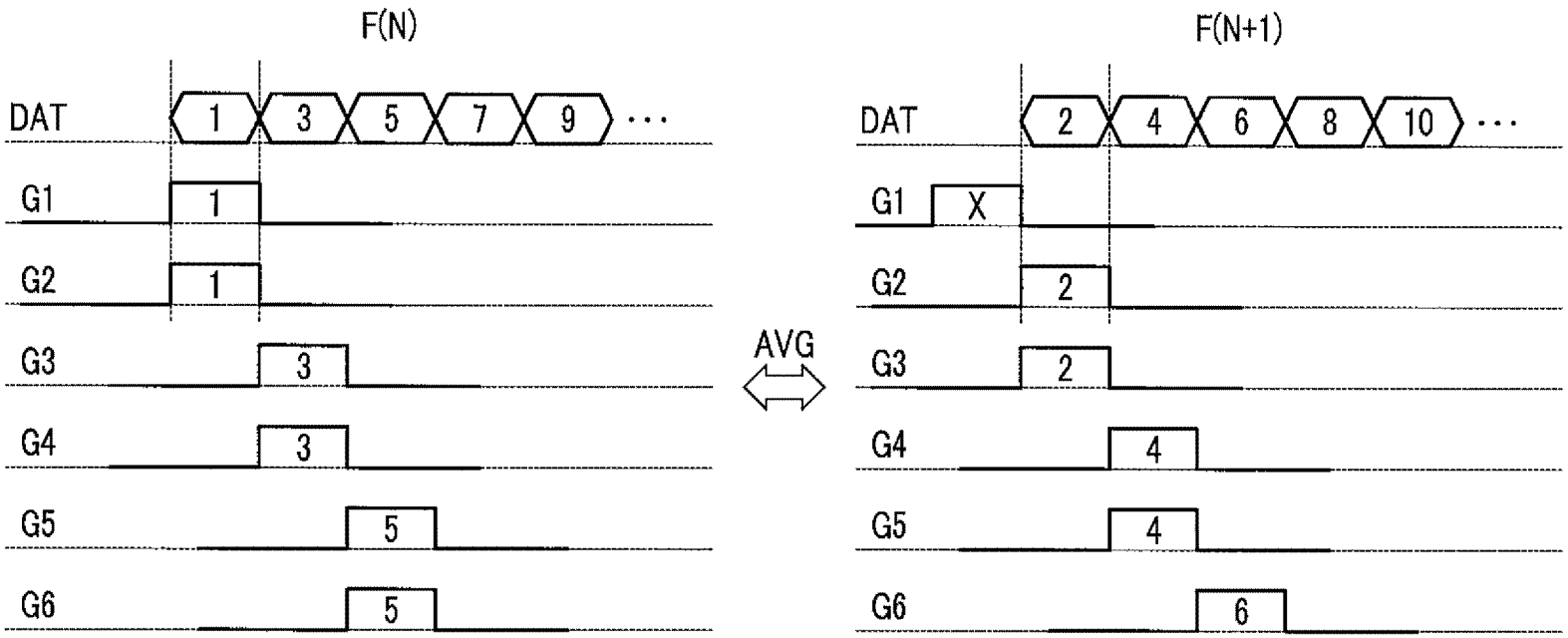

A display device and corresponding gate doubling method according to an embodiment of the present invention will now be described with reference to FIG. 26 to FIG. 28.

The method for driving a display device mostly corresponds to the driving method according to the embodiment described with reference to FIG. 22 to FIG. 25, the time for applying the gate-on voltage pulse to the odd-numbered gate lines G1, G3, and G5 becomes simultaneous with the time for applying the gate-on voltage pulse to the next even-numbered gate lines G2, G4, and G6 in the odd frame F(N), it becomes simultaneous with the time for applying the gate-on voltage pulse to the previous even-numbered gate lines G2, G4, and G6 in the even frame F(N+1), and the two frames F(N) and F(N+1) are alternated and driven. Therefore, a section for applying the gate-on voltage Von to the first gate line G1 partially overlaps the vertical blank section VB in the even frame F(N+1) so the temporally interpolated voltage substantially applied to the pixels PX connected to the first gate line G1 may be less than (e.g., ½) the output image data DAT_G1, such as ½ DAT_G1 or Avg(X, DAT_G1).

By visual interpolation, as shown in FIG. 26, the pixels PX connected to the gate lines G1-G6 may express the same average luminance as that charged with the interpolated value of the corresponding output image data and the output image data corresponding to the pixels PX connected to the gate lines G1-G6 of the previous row, for example, the averaged value. Various features and effects of the embodiment described with reference to FIG. 22 to FIG. 25 are equivalently applicable to the present embodiment.

Figure 29:
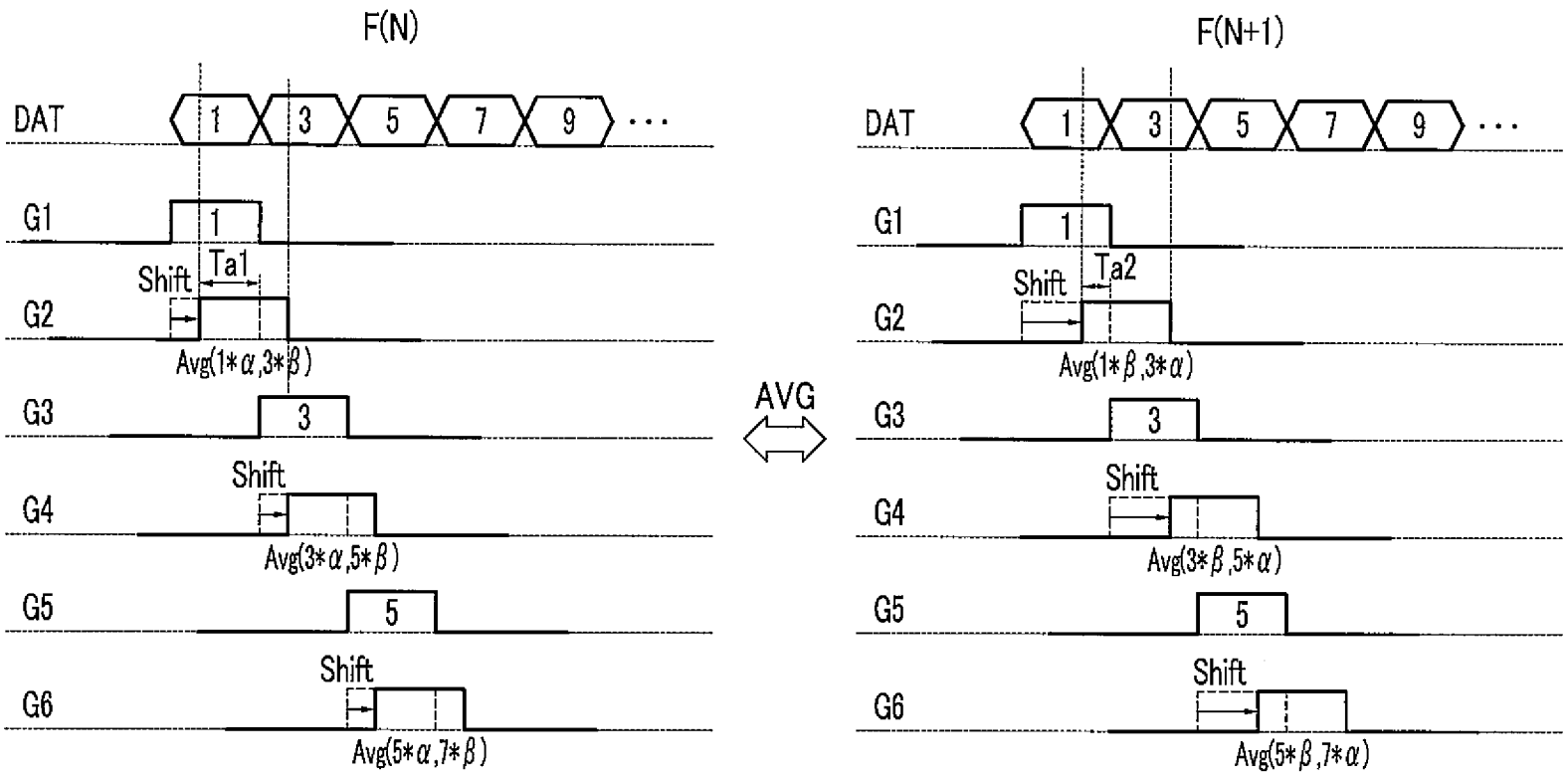
FIG. 29 is a timing diagram of output image data and gate signals output to a display panel in neighboring frames when a display device is driven by a gate doubling scheme of still another embodiment of the present invention.

A display device and corresponding gate doubling method according to still another embodiment of the present invention will now be described with reference to FIG. 29.

The method for driving a display device according to the present embodiment mostly corresponds to the driving method according to the embodiment described with reference to FIG. 6 to FIG. 12, and shift amounts of the gate-on voltage Von pulse applied to the even-numbered gate lines G2, G4, and G6 in the neighboring frames F(N) and F(N+1) may be different from each other. For example, referring to FIG. 29, the overlapping section Ta1 with the gate-on voltage pulse applied to the previous odd-numbered gate lines G1, G3, and G5 from among the gate-on voltage pulses applied to the even-numbered gate lines G2, G4, and G6 in the odd frame F(N) may be different from the overlapping section Ta2 in the even frame F(N+1).

According to the present embodiment, a vertical interpolation effect of the image data induced by a timing shift of the even-numbered gate lines G2, G4, and G6 (e.g., a different overlapping section Ta1 in the odd frame F(N) versus the overlapping section Ta2 in the even frame F(N+1)), and a temporal interpolation effect caused by alternation according to the frame of the timing shift amount may occur simultaneously. For example, the ratio Ta1:Ta2 may be $\alpha:\beta$, where $\alpha+\beta=1$ represents the time of a horizontal period, as shown in FIG. 29.

In other embodiments, the starting point for applying the gate-on voltage pulse applied to the odd-numbered gate lines G1, G3, and G5 may be shifted forward to be provided between the time when the gate-on voltage Von starts to be applied to the previous even-numbered gate lines G2 and G4 (and a time corresponding to the vertical blank section) and the time when the gate-on voltage Von starts to be applied to the even-numbered gate lines G2, G4, and G6, and the frames with different timing shift amounts may be alternated and driven.

Further, in other embodiments, the odd-row compressed data (or odd-row interpolated and compressed data) and the even-row compressed data (or even-row interpolated and compressed data) may be alternated and input to the data driver 500, and the corresponding data voltages Vd may be applied to the pixels PX.

A display device and corresponding driving method according to another embodiment of the present invention will now be described with reference to FIG. 30 and FIG. 31 together with the above-described drawings.

Figure 30:
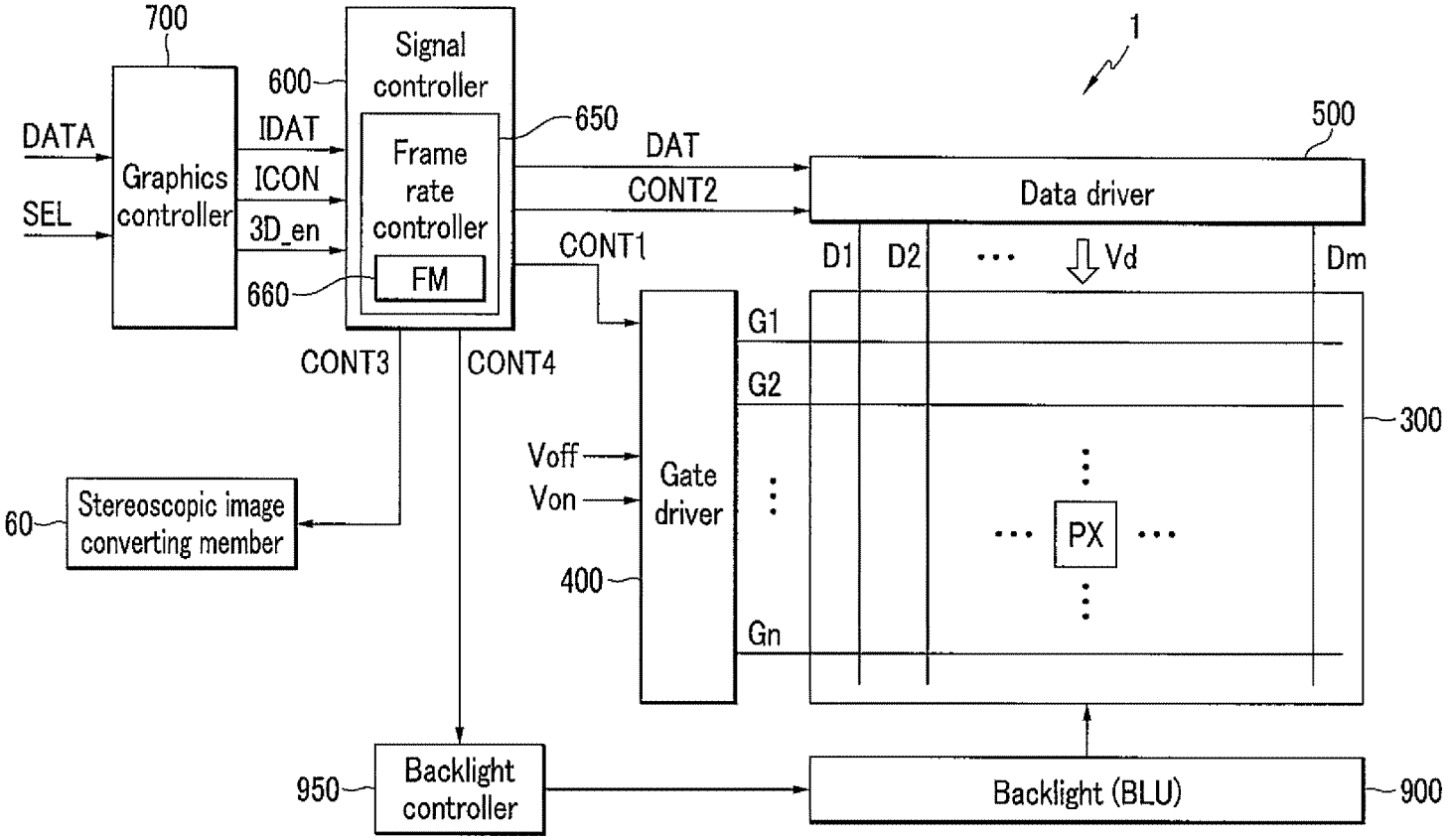
FIG. 30 is a block diagram of a display device according to another embodiment of the present invention.

Referring to FIG. 30, a display device 1 mostly corresponds to the display device 1 according to the embodiment described with reference to FIG. 1, and it may further include a graphics controller 700, a backlight unit 900 for providing light to the display panel 300, a backlight controller 950 for controlling the backlight unit 900, and a stereoscopic image converting member 60. Differences from the above-described embodiment will now be described.

The graphics controller 700 may receive image information DATA and mode selection information SEL from an external device. The mode selection information SEL may include selection information on 2D/3D modes for displaying an image whether in the 2D mode or the 3D mode. The graphics controller 700 generates input image data IDAT and input control signals ICON for controlling displaying of the input image data IDAT by using the image information DATA and the mode selection information SEL. The graphics controller 700 may further generate a 3D enable signal 3D_en when the mode selection information SEL includes information for selecting the 3D mode. The input image data IDAT, the input control signals ICON, and the 3D enable signal 3D_en may be transmitted to the signal controller 600. The 3D enable signal 3D_en instructs the display device to be operable in the 3D mode and display a stereoscopic image, and may be omitted in other embodiments.

The signal controller 600 generates stereoscopic image control signals CONT3 and backlight control signals CONT4 in addition to gate control signals CONT1 and data control signals CONT2. The signal controller 600 transmits the stereoscopic image control signals CONT3 to the stereoscopic image converting member 60, and the backlight control signals CONT4 to the backlight controller 950.

The signal controller 600 may be operated in the 2D mode for displaying a 2D image or the 3D mode for displaying a 3D image according to the 3D enable signal 3D_en provided by the graphics controller 700. In the 3D mode, the output image data DAT may include image signals with different viewpoints. In the 3D mode, one pixel PX of the display panel 300 may alternately display data voltages corresponding to the image signals with different viewpoints or the different pixels PX may display the data voltages corresponding to the image signals with different viewpoints.

The stereoscopic image converting member 60 realizes displaying of stereoscopic images, and it allows images corresponding to respective different viewpoints to be recognized at the respective viewpoints. The stereoscopic image converting member 60 is operable in synchronization with the display panel 300.

For example, the stereoscopic image converting member 60 may allow an image for the left eye (i.e., left-eye image) to be input to the left eye of the observer and an image for the right eye (right-eye image) to be input to the right eye to generate binocular disparity. As such, the stereoscopic image converting member 60 allows the observer to perceive a three-dimensional effect by outputting different images from different viewpoints.

Figure 31:
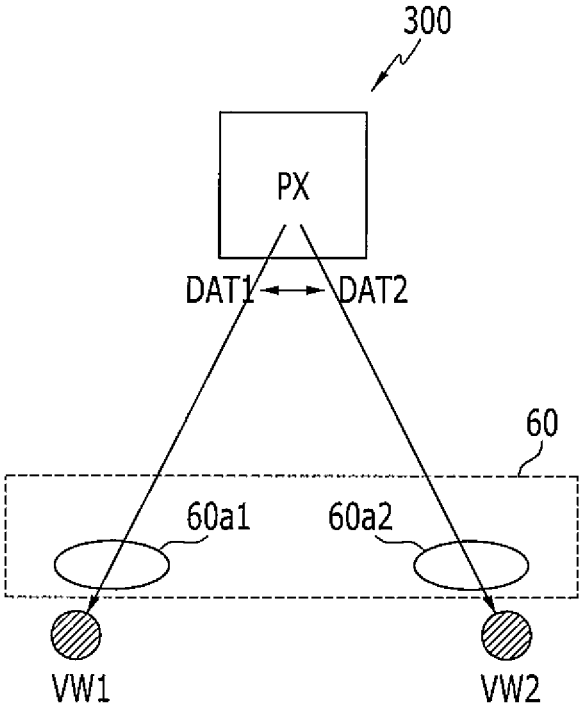
FIG. 31 illustrates a method for displaying a stereoscopic image by the display device of FIG. 30.

Referring to FIG. 31, the stereoscopic image converting member 60 may include shutter glasses 60*a*1 and 60*a*2 for allowing respective eyes of the observer to observe different images. The pixels PX of the display panel 300 may display the output image data DAT1 for a first viewpoint VW1 and the output image data DAT2 for a second viewpoint VW2 at different times, and the observer may observe respective images by using the shutter glasses 60*a*1 and 60*a*2 that are operable in synchronization with the display panel 300 at the first viewpoint VW1 and the second viewpoint VW2, which are different viewpoints (e.g., left-eye images and right-eye images). The shutter glasses 60*a*1 at the first viewpoint VW1 and the shutter glasses 60*a*2 at the second viewpoint VW2 may be turned on/off at different times (to coincide with the displaying of the output image data DAT1 for the first viewpoint VW1 and the displaying of the output image data DAT2 for the second viewpoint VM2).

Regarding the stereoscopic image display device, different observers may observe respective images through the shutter glasses 60*a*1 and 60*a*2 at the first viewpoint VW1 and the second viewpoint VW2, and one observer may observe the left-eye image and the right-eye image through his left eye and right eye by using the shutter glasses 60*a*1 and 60*a*2 at the first viewpoint VW1 and the second viewpoint VW2.

For example, when the display panel 300 alternately displays the left-eye image corresponding to the first viewpoint VW1 and the right-eye image corresponding to the second viewpoint VW2, the shutter glasses 60*a*1 and shutter glasses 60*a*2 may be synchronized to it to alternately allow the light to be passed through or blocked. The observer may then recognize the images of the display panel 300 as stereoscopic images through the shutter glasses 60*a*1 and 60*a*2.

The stereoscopic image display device for displaying images at different viewpoints should have a frame rate at least twice that of displaying a 2D image to display normal stereoscopic images without flicker. At least a 60 Hz frame rate may be needed in consideration of the characteristics of the human eyes, so the stereoscopic image display device for displaying the left-eye images and the right-eye images may need at least a 120 Hz frame rate, and further may need a 240 Hz frame rate to reduce crosstalk. By using one of the above-described gate doubling driving schemes (or variations of these schemes that are described or would be obvious to one of ordinary skill) for increasing the frame rate, sufficient charging time may be obtained and the frame rate may be increased.

Accordingly, when the display device for displaying stereoscopic images according to the gate doubling driving scheme alternately displays the images from different viewpoints, the anti-aliasing may be achieved by applying aspects of the above-described various embodiments.

In this case, the image data of the odd frame F(N) and the image data of the even frame F(N+1) may be neighboring frame images from an identical viewpoint. For example, the image data of the odd frame F(N) and the image data of the even frame F(N+1) may be image data of the N-th frame of the left-eye image and image data of the (N+1)th frame of the left-eye image, or they may be image data of the N-th frame of the right-eye image and image data of the (N+1)th frame of the right-eye image. In this case, the anti-aliasing effect is obtained by temporal interpolation (e.g., average) from the identical viewpoint.

In other embodiments, the image data of the odd frame F(N) and the image data of the even frame F(N+1) may be left-eye image data and right-eye image data for one stereoscopic image. In other words, the image data of the odd frame F(N) and the image data of the even frame F(N+1) may be viewpoint changed image data at the identical time, such as the left-eye image data of the N-th frame and the right-eye image data of the same N-th frame. In this case, the anti-aliasing effect may be obtained through visual averaging caused by processing image information from different viewpoints in the brain of the observer.

According to some embodiments of the present invention, in display devices that alternately display images from different viewpoints, the frame alternation in the driving method may include the two above-noted cases.

A pre-charging driving method for applying a gate-on voltage pulse in advance at a set or predetermined time may also be applied to the above-described timing diagrams according to other embodiments to allow for sufficient charging time of the data voltages.

Further, the gate doubling driving method for simultaneously driving the gate lines G1-Gn by pairs has been described in the above-noted embodiment, and by generalization, a method for simultaneously driving the gate lines G1-Gn by k (k>2) gate lines may also be applied as an embodiment of the present invention.

While the present invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A method for driving a display device comprising a plurality of gate lines, a plurality of data lines, a plurality of pixels each including at least one switching element connected to at least one of the gate lines and at least one of the data lines, a data driver, a gate driver, and a signal controller for controlling the data driver and the gate driver, the method comprising:

compressing, by the signal controller, vertical resolution of input image data of each of a plurality of frames including a first frame by k (k is a natural number greater than one) or receiving by the signal controller the compressed input image data;

processing by the signal controller the compressed input image data to generate output image data;

generating, by the data driver, data voltages based on the output image data and applying the data voltages to the data lines; and applying, by the gate driver, gate-on voltage pulses concurrently to k neighboring ones of the gate lines corresponding to the applied data voltages, wherein, in the first frame, starting times of the gate-on voltage pulses of at least two gate lines from among the k neighboring ones of the gate lines are different from each other, wherein the output image data comprise interpolated and compressed data for alternating rows of the pixels that is generated by interpolating the input image data corresponding to respective preceding and subsequent rows.

2. The method of claim 1, wherein the output image data comprise first output image data and second output image data, the data voltages comprise first data voltages and second data voltages corresponding to the first output image data and the second output image data, respectively, the first data voltages and the second data voltages being consecutively applied to the data lines, the k neighboring ones of the gate lines comprise a first k neighboring ones of the gate lines and a second k neighboring ones of the gate lines, the first k neighboring ones of the gate lines corresponding to the applied first data voltages and the second k neighboring ones of the gate lines corresponding to the applied second data voltages, the first k neighboring ones of the gate lines comprise a first gate line and a second gate line, the second k neighboring ones of the gate lines comprise a third gate line and a fourth gate line, and the gate-on voltage pulses comprise first, second, third, and fourth gate-on voltage pulses for respectively applying to the first, second, third, and fourth gate lines, the starting time for the second gate-on voltage pulse being between those of the first gate-on voltage pulse and the third gate-on voltage pulse.

3. The method of claim 2, wherein the first gate-on voltage pulse is applied in synchronization with the applied first data voltages, and the third gate-on voltage pulse is applied in synchronization with the applied second data voltages.

4. The method of claim 3, wherein the output image data comprise odd-row compressed data or odd-row interpolated and compressed data, the odd-row compressed data are generated by extracting the input image data corresponding to an odd row of the pixels, and the odd-row interpolated and compressed data are generated by interpolating the input image data corresponding to an even row of the pixels preceding the odd row and the input image data corresponding to an even row of the pixels following the odd row.

5. The method of claim 3, wherein in a second frame of the plurality of frames alternating with the first frame with a vertical blank section therebetween, a section of the first gate-on voltage pulse overlaps the vertical blank section.

6. The method of claim 5, wherein in the first frame, the output image data comprise odd-row compressed data or odd-row interpolated and compressed data, in the second frame, the output image data comprise even-row compressed data or even-row interpolated and compressed data, the odd-row compressed data are generated by extracting the input image data corresponding to odd rows of the pixels, the odd-row interpolated and compressed data are generated by interpolating the input image data corresponding to respective even rows of the pixels preceding the odd rows and the input image data corresponding to respective even rows of the pixels following the odd rows, the even-row compressed data are generated by extracting the input image data corresponding to even rows of the pixels, and the even-row interpolated and compressed data are generated by interpolating the input image data corresponding to respective odd rows of the pixels preceding the even rows and the input image data corresponding to respective odd rows of the pixels following the even rows.

7. The method of claim 3, wherein lengths of an overlapping section of the first gate-on voltage pulse and the second gate-on voltage pulse are different from each other in two neighboring frames of the plurality of frames.

8. The method of claim 7, wherein the output image data comprise odd-row compressed data or odd-row interpolated and compressed data, the odd-row compressed data are generated by extracting the input image data corresponding to an odd row of the pixels, and the odd-row interpolated and compressed data are generated by interpolating the input image data corresponding to an even row of the pixels preceding the odd row and the input image data corresponding to an even row of the pixels following the odd row.

9. The method of claim 1, wherein the input image data in the first frame comprise image data for a first viewpoint, and the input image data in a second frame following the first frame from among the plurality of frames comprise image data for a second viewpoint different from the first viewpoint.

10. The method of claim 1, wherein the input image data in the first frame and the input image data in a second frame following the first frame from among the plurality of frames comprise image data for the same viewpoint.

11. A display device comprising:

a plurality of gate lines and a plurality of data lines;

a plurality of pixels each including at least one switching element connected to at least one of the gate lines and at least one of the data lines;

a signal controller for compressing vertical resolution of input image data of each of a plurality of frames including a first frame by k (k is a natural number greater than one) or receiving the compressed input image data, and processing the compressed input image data to generate output image data;

a data driver for generating data voltages based on the output image data and applying the data voltages to the data lines; and a gate driver for applying gate-on voltage pulses concurrently to k neighboring ones of the gate lines corresponding to the applied data voltages, wherein, in the first frame, starting times of the gate-on voltage pulses of at least two gate lines from among the k neighboring ones of the gate lines are different from each other, wherein the output image data comprise interpolated and compressed data for alternating rows of the pixels that is generated by interpolating the input image data corresponding to respective preceding and subsequent rows.

* * * * *